United States Patent [19]

Hyosu et al.

[11] Patent Number: 4,839,255

[45] Date of Patent: Jun. 13, 1989

[54] PROCESS FOR PRODUCING TONER FOR DEVELOPING ELECTROSTATIC IMAGES

[75] Inventors: Yoshihiko Hyosu, Machida; Norio Hikake; Katsuhiko Tanaka, both of Yokohama, all of Japan

[73] Assignee: Canon Kabushiki Kaisha, Tokyo, Japan

[21] Appl. No.: 174,896

[22] Filed: Mar. 29, 1988

[30] Foreign Application Priority Data

Mar. 31, 1987 [JP] Japan ..... 62-078029
Mar. 31, 1987 [JP] Japan ..... 62-078030

[51] Int. Cl.[4] ..... G03G 9/00
[52] U.S. Cl. ..... 430/137; 264/69
[58] Field of Search ..... 430/137

[56] References Cited

U.S. PATENT DOCUMENTS 4,288,519 9/1981 Diamond et al. ..... 430/137

*Primary Examiner*—J. David Welsh
*Attorney, Agent, or Firm*—Fitzpatrick, Cella Harper & Scinto

[57] ABSTRACT

A toner for producing electrostatic latent images is produced by mixing base particles (A) with specific modifier particles (B) to attach the modifier particles (B) to the surfaces of the base particles (A), and passing the resultant mixture through a specific impact zone thereby to fix the modifier particles (B) to the base particles (A) under the action of a mechanical impact force.

33 Claims, 7 Drawing Sheets

PROCESS FOR PRODUCING TONER FOR DEVELOPING ELECTROSTATIC IMAGES

FIELD OF THE INVENTION AND RELATED ART

The present invention relates to a process for producing a toner for developing electrostatic images in electrophotography, electrostatic recording and electrostatic printing.

Hitherto, a large number of electrophotographic processes have been known, as disclosed in U.S. Pat. No. 2,297,691 and Japanese Patent Publication (JP-B, Kokoku) Nos. 23910/1967 and 24748/1968. Generally speaking, photoconductive materials are utilized in these processes and the steps included therein comprise forming electrical latent images on photosensitive members by various means, then developing the latent images by using a toner, transferring the toner images thus formed to a recording medium such as paper, as desired, and thereafter fixing the images by heating, pressure or solvent vapor to obtain copies.

Such a toner is generally permitted to possess positive or negative charge, depending on the polarity of the electrostatic latent image to be developed. There may be a method in which a toner is charged only by use of the triboelectrical chargeability of a binder resin contained in the toner. In such a case, however, images obtained by development are ordinarily liable to cause fog and to be unclear, due to a small chargeability of the toner.

Therefore, it has been becoming a general practice to add a charge controller or charge controlling agent, in order to impart sufficient triboelectrical charging characteristic to the toner.

Positive charge controllers known in the art include compounds such as nigrosine, azine dyes, and quaternary ammonium salts. On the other hand, known negative charge controllers include compounds such as a metal complex of a monoazo dye, and a Co, Cr or Fe complex of salicylic acid. These charge controllers are usually added to a thermoplastic resin to be dispersed in the resin while it is molten under heating, and the resultant resin mixture is micropulverized into fine particles and, if desired, adjusted to suitable particle sizes.

However, it is very difficult to disperse these charge controllers evenly into a thermoplastic resin, and their contents in toner particles obtained by pulverization are not constant to result in different amounts of triboelectric charges among the toner particles. For this reason, in the prior art, various methods have been practiced in order to disperse the charge controller more evenly into a resin. For example, a basic nigrosine dye is formed into a salt with a higher fatty acid for improvement of compatibility with a thermoplastic resin. In this case, however, unreacted fatty acid or decomposed product of the salt will be exposed on the toner surfaces to contaminate carriers or toner-carrying member and also cause lowering in free flowing property of the toner, fog and lowering in image density. Alternatively, for improvement in dispersibility of these charge controllers into a resin, there is also employed a method in which powder of a charge controller and resin powder are previously mechanically pulverized and mixed before fusion kneading. This method is not competent enough to overcome the original poor dispersibility, and evenness of charging satisfactory in practical application has not yet been otained. Accordingly, there has been desired improvement for providing sufficient uniformity in the triboelectric charge.

On the other hand, in copying machines or printers, two-color or full-color copying machines have recently been studied and practically used, in addition to the conventional mono-color copying machines. Further, in view of higher efficiency in copying operation, further reduction in energy consumption, further miniaturization in size, higher speed and higher performances, the heat roller-type fixing system has mostly been used in commercially available copying machines. In most of these copying machines, toner images are fixed onto paper under heat and pressure due to a hot roller.

Such pressure heating system has some advantages that it may provide good fixed images by using a heating member at a lower temperature than that in a non-contact-type heating system using a heat wave, and that it may provide a higher speed operation. However, this pressure fixing system also has some disadvantages and serious one is contamination of a hot roller. More specifically, when the hot roller is held at a temperature such that a toner is sufficiently fixed onto a toner-receiving member such as paper, the toner may be attached not only to the paper but also to the hot roller through fusion. As a result, the thus attached toner contaminates the hot roller in repetitive copying. Incidentally, such toner attached to the hot roller is not sufficiently removed by a blade or a cleaning web for cleaning the hot roller and is then retransferred onto the next sheet to be fixed, whereby the so-called "hightemperature offset phenomenon" may sometimes occur to contaminate the sheet to be fixed. Such offset phenomenon is a serious problem in the above-mentioned contact-type system.

In order to obviate or reduce the offset phenomenon, various attempts have been made from both sides of a fixing device and a toner, but further improvement has been desired Concerning the technique for improvement of the binder resin for toner, for example, Japanese Patent Publication (JP-B, Kokoku) No. 23354/1976 (corresponding to U.S. Pat. No. 3,941,898) proposes a toner by using a crosslinked polymer (mainly of a styrene-type resin) as the binder resin. While this method has an effect of considerably improving antioffset characteristic and anti-winding characteristic, on the other hand, fixing point is elevated by increasing the degree of the crosslinking. Particularly, when color or chromatic toners of respective colors are used to obtain a color copied image, such elevation of the fixing point considerably impairs the image quality. More specifically, not only the luster and the gloss of the image which are important characteristics of a color copied image are lost, but also reproducibility in color tone deteriorates. Further, the dispersibility of a colorant such as pigment in the above-mentioned crosslinked polymer may deteriorate, whereby the developing characteristics of the toner also deteriorates because of the dispersibility of the colorant.

Further, Japanese Laid-Open Patent Application (JP-A, Kokai) No. 106554/1983 proposes a method wherein monodisperse spherical core particles are coated with a polymer substance containing a colorant. In this method, e.g., the monodisperse spherical core particles are added into a solution comprising a solvent such as cyclohexane and methanol, and the polymer substance and the colorant dissolved or dispersed therein, and then the solvent is removed to coat the core particles. In this method, however, it is necessary to considerably suppress the amount of the polymer substance in the solvent, in order to obtain good coating. Further, a device for removing the solvent is required thereby to increase the production cost and to complicate the production steps. Further, it is technically difficult to prevent the agglomeration of the particles in the step of concentrating the solution, and there is required a special technique for preventing the agglomeration, or the disintegration of the agglomerates a disclosed in the above-mentioned publication. Moreover, while the core particles are required not to be dissolved in the solvent, the coating polymer substance is required to be dissolved in the solvent. Accordingly, the materials of the core particles and the coating polymer substance are severely restricted.

On the other hand, there has been proposed another method wherein core particles are coated by using a dispersion (mainly of an aqueous dispersion) comprising a polymer substance and a colorant. In such method, similarly as in the above-mentioned method using a solvent, it is necessary to use a device for removing water, whereby the production cost increases. Further, it is technically difficult to prevent the agglomeration of the particles in the step of concentrating the dispersion, and it is also necessary to use an additive such as an emulsifier in order to disperse the highly hydrophobic core particles in water. The emulsifier is generally a hydrophilic substance which impairs the triboelectric chargeability of a high insulation-type toner, particularly under a high-humidity condition. Accordingly, it is necessary to remove the emulsifier but the removal thereof is technically difficult. As a result, it is preferred to coat the core particles without using the emulsifier.

Further, there has been proposed a method wherein core particles are coated by fusing powders of a polymer substance and a colorant by heating. In this method, it is necessary to adjust the temperature to one which is sufficeintly low so as to suppress the thermal agglomeration of the core particles as perfectly as possible, and which is sufficiently high so as to bond the polymer substance as a coating material to the core particles. Such adjustment of the temperature, which intends to prevent the thermal fusion of mutual core particles, is very important. However, in this thermal fusion of the polymer substance as the coating material, the core particles not a little heat-fuse. The reason for this is as follows: A toner used in electrophotography provides a copy through a process wherein the toner image is transferred to a recording medium such as paper and then fixed by heating, pressure, or heating and pressure. Because the toner is required to melt by heating and/or pressure in such fixing step, the material of the core particles mainly comprises a thermoplastic resin.

In a case where the polymer substance is attached to the entire surfaces of the core particles, even when the core particles are heat-melted, the agglomeration thereof may be prevented to some extent because of the shell of the polymer substance. However, in a case where the coating substance is partially attached to the surfaces of the core particles, it is difficult to prevent the thermal agglomeration of the core particles due to the thermal fusion thereof. Further, in this method, it is technically difficult to prepare a toner wherein the core particles are partially coated with the coating substance.

JP-A (Kokai) No. 210368/1986 proposes a method wherein a binder resin and a colorant are dispersed on the surfaces of spherical core particles by means of a mixer such as a Henschel mixer and a Super Mixer, and the binder resin and the colorant are fixed to the core particles by heat-treating the resultant mixture at a temperature which is lower than the solftening point of the spherical core particles and is higher than that of the binder resin. In this method, however, it is necessary in view of materials, that the softening point of the binder resin is lower than that of the spherical core particles. Further, when the spherical core particles are heat-treated at a temperature of 110°-140° C. for 10 min. as disclosed in the specific example of the above-mentioned application, it is technically difficult to prevent the thermal agglomeration or thermal fusion of the spherical core particles. Further, the materials used can be deteriorated by heating depending on the property thereof. Accordingly, the problems have not yet been sufficiently solved in the prior art.

Thus, it has strongly been desired that a charge controller is uniformly distributed or imparted to individual toner particles.

Further, as mentioned above, there has been desired a color toner which has sufficient anti-high-temperature-offset characteristics and sufficient releasability to a hot fixing roller, and has wide color-reproducibility so as to provide good developing characteristics and suitable gloss as a color image.

Incidentally, in a capsule toner which is mainly used in a pressure-fixing system, there has been posed a problem in the dispersibility of a colorant in a binder resin mainly comprising a wax type substance. Therefore, a color toner having wide color-reproducibility has not yet been obtained.

SUMMARY OF THE INVENTION

An object of the present invention is to provide a process for producing a toner for developing electrostatic images, wherein the above-mentioned various problems found in the prior art are overcome.

Another object of the present invention is to provide a process for producing a toner capable of being uniformly and stably charged.

Further object of the present invention is to provide a process for producing a toner for electrophotography capable of providing a color copied image having sufficient gloss and luster.

According to the present invention, there is provided a process for producing a toner for developing electrostatic latent images comprising: mixing resinous base particles (A) comprising at least a binder resin with modifier particles (B) comprising a colorant or a charge controller thereby to attach the modifier particles (B) to the surfaces of the base particles (A); and introducing the base particles (A) and the modifier particles (B) to a fixing means which has an impact zone having a minimum clearance of 0.5–5 mm between a rotating member and a fixed member or between at least two rotating members, and passing the particles through the impact zone at a temperature of 10°-100° C., thereby to fix the modifier particles (B) to the surfaces of the base particles (A) under the action of a mechanical impact force exerted in the impact zone.

These and other objects features and advantages of the present invention will become more apparent upon a consideration of the following description of the preferred embodiments of the present invention taken in conjunction with the accompanying drawings.

DETAILED DESCRIPTION OF THE INVENTION

Figure 1:
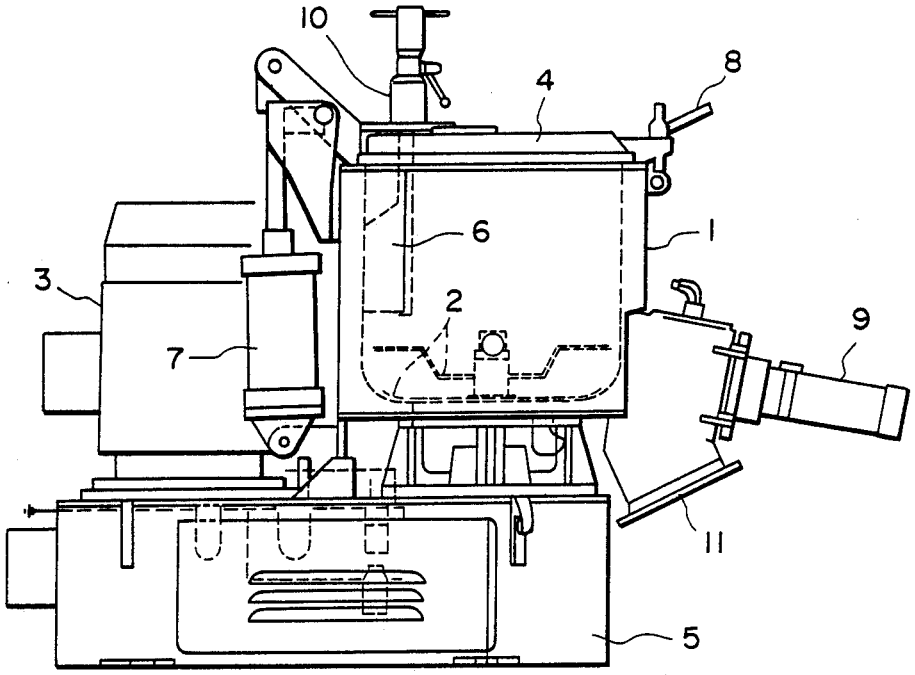
FIG. 1 is a schematic sectional view showing an embodiment of a stirring device for pretreating base particles (A) and modifier particles (B)

Hereinbelow, there will be described an embodiment of the process according to the present invention, wherein colored modifier particles (B1) are fixed to the surfaces of resinous base particles (A).

In the present invention, the modifier particles (B1) comprising a colorant (inclusive of magnetic powder) are mixed with the resinous base particles (A) in powdery states, whereby there is obtained a toner wherein the colored modifier particles (B1) are fixed onto the base particles (A). The resinous base particles (A) can be substantially colorless particles (A1) containing no colorant.

Incidentally, in the conventional toner produced by melt-keanding, pulverization and classification, it is technically difficult to uniformly disperse such colorant in a binder resin, particularly when a crosslinked binder resin is used in order to improve the fixability of the toner. Therefore, in the prior art, it has not been easy to obtain a color toner which has wide color-reproducibility so as to provide good developing characteristics and suitable gloss as a color copied image. The reason for this is that there is a difference between the dispersibility of the binder resin in the melt-kneading step and that of the colorant, and that the dispersibility varies depending on the method of melt-kneading. While there may be considered a method wherein the melt-kneading temperature is lowered to enhance the dispersibility of the colorant, a trouble such as cleavage of the binder molecules or decomposition of the colorant can be caused in such method. As a result, a melt-kneading method suitable for the colorant is not necessarily adopted.

On the other hand, in case of a toner obtained through suspension polymerization, there is no trouble about the above-mentioned cleavage of binder resin molecules in melt-kneading, but there may be caused a trouble about the dispersibility or mixability of a colorant in a monomer having a low viscosity. As a result, the suspension polymerization method may also have the above-mentioned problem. Further, since a colorant added to the monomer can sometimes inhibit the polymerization, the use of the colorant is limited in some cases.

Further, in case of a capsule toner of which surface is coated with a resinous substance, there may be caused a trouble about the dispersibility or mixability of a colorant mainly in a wax-type substance having a low viscosity.

On the contrary, in the present invention, the modifier particles (B1) comprising a colorant (inclusive of magnetic powder) are fixed onto the base particles (A) under the action of a mechanical impact force in powdery states. The modifier particles (B1) may preferably be fixed to partial surfaces of the base particles (A), as described hereinafter.

Incidentally, in an insulating toner, it is important to adjust the triboelectric charge thereof to a constant value. In order to obtain good images under different environmental conditions, and to obtain good images, which are not substantially different from the initial image, in successive image formation, it is important how to control the triboelectric charge of the toner.

Generally speaking, a colorant functions so as to suppress the absolute amount of a toner charge. As a result, particularly under a high-humidity condition, the colorant can prolong the period of time for toner to have a sufficient amount of charge, and can cause a problem that there cannot be excluded toner particles which attach to a portion other than a latent image portion of an image-bearing member under the action of a force other than an electric force. As a result, such toner particles contaminate the resultant toner image. However, in the present invention, the above-mentioned problem may be solved by fixing resinous modifier particles (B1) comprising a colorant to partial surfaces of base particles (A).

In an embodiment of the process according to the present invention, wherein the resinous modifier particles (B1) comprising a colorant are produced, it is possible to select a resin or to adopt a kneading method in view of the dispersibility of the colorant. In the present invention, the modifier particles (B1) are fixed to the base particles (A) under the action of a mechanical impact force. As a result, the modifier particles are not substantially freed from the base particles, and both the modifier particles and the base particles function as the unity of a toner in the sequential steps, e.g., a step wherein an external additive such as silica is mixed with the toner under stirring, or a step wherein the toner is stirred or rubbed in order to develop a latent image.

In the present invention, it is possible to use common colorless resinous particles as the base particles (A1), whereby the production cost may preferably be reduced in the production of color or chromatic toners which are generally used in relatively small amounts and relatively man kinds.

In such embodiment of the present invention, the resinous modifier particles (B1) comprising a colorant is mixed with the colorless resinous bas particles (A1) in powdery states to fix the colorant onto the colorless base particles (A1), whereby a color toner having good reproducibility in color may be obtained. Further, in the colorless resinous base particles (A1), there is little trouble of the cleavage in the polymer chain, which can be caused in the conventional melt-kneading of a resin and a colorant. In the present invention, it is possible to select a crosslinked resin excellent in fixability without consideration of the dispersibility of the colorant, whereby a color toner having good fixability and good color-reproducibility may be obtained.

In a case where the base particles (A1) are prepared through suspension polymerization, it is possible to select a monomer from a wide scope thereof without consideration of the inhibition by or dispersibility of a colorant.

On the other hand, in the modifier particles (B1), the weight ratio of the colorant to the resin (colorant: resin) may preferably be 1:99 to 99:1, more preferably 5:95 to 95:5. An additive used in electrophotography such as a release agent, a charge controller and an abrasive may be added into the modifier particles (B1), as desired. Particularly, the release agent may preferably be used in order to enhance the fixability, and particularly to enhance the anti-offset and anti-winding characteristics of the toner. The release agent may preferably be used in an amount of 1–10 wt. % based on the weight of the resinous modifier particles (B1) comprising the colorant.

The ratio of the volume-average particle size of the modifier particles (B1) to that of the colorless base particles (A1) may preferably be 0.2 or less, more preferably 0.001–0.15. If the ratio between the volume-average particle sizes is above 0.2, it is difficult to uniformly fix the modifier particles (B1) to the surfaces of the colorless base particles (A1).

In the present invention, the coverage of the base particles (A1) wit the modifier particles (B1), i.e., the proportion of the surface areas of base particles (A1) covered with the modifier particles (B1) to the total surface areas of the base particles (A1), is determined by the following formula:

$$\text{Coverage } (\%) = \tfrac{1}{4} \times (W_2 x R_1 x M_1 / W_1 x R_2 x M_2) \times 100,$$

wherein $W_1$ and $W_2$ respectively denote the weight of the base particles (A1) and that of the modifier particles (B1); $R_1$ and $R_2$ respectively denote the volume-average particle size of the base particles (A1) and that of the modifier particles (B1); and $M_1$ and $M_2$ respectively denote the true density of the base particles (A1) and that of the modifier particles (B1).

In the present invention, the coverage may preferably be 30–80%. If the coverage is below 30%, the tinting strength may be insufficient. On the other hand, if the coverage is above 80%, the triboelectric charge of the toner may be affected whereby the image density of a toner image tends to be lowered. Incidentally, the modifier particles (B1) may preferably be used in an amount of 0.01–20wt. parts, per 100 wt. parts of the base particles (A).

In the present invention, a particle size distribution is measured by the following method.

Coulter Counter Model TA-II (mfd. by Coulter Electronics Inc.) or Elzone Particle Counter Model 80 XY-2 (mfd. by Particle Data Inc, U.S.A.) is used as a measuring device and a number-average particle size distribution and a volume-average particle size distribution are outputted. A 1–4% aqueous NaCl solution is used as an electrolytic solution.

In the measurement, 0.1–5 ml of a surfactant, as a dispersing agent, preferably of alkylbenzenesulfonate is added to 100–150 ml of the above-mentioned aqueous electrolytic solution, and further 0.5–50 mg of a sample for measurement is added to the resultant mixture and suspended. The resultant suspension of the sample in the electrolytic solution is dispersed by means of an ultrasonic dispersing device for about 1–3 min. Thereafter, the particle size distribution of particles having a particle size of 0.2–40 μm is measured by means of the above-mentioned Coulter Counter TA-II or Elzone Particle Counter 80 XY-2 with an aperture of 12–120 microns, whereby the number-average particle size distribution and the volume-average particle size distribution are determined.

The modifier particles (B1) may be prepared in the following manner.

(a) The components constituting the modifier particles (B1) are melt-kneaded, cooled and pulverized in a general manner to obtain fine particles. As desired, the pulverized product may be classified to obtain desirable fine particles.

(b) A monomer is suspension-polymerized in the presence of a colorant without the above-mentioned problems in a solvent which dissolves the monomer but does not dissolve the polymer produced from the monomer, whereby fine polymer particles containing the colorant are prepared. Fine particles may be obtained by removing the solvent from the reaction product.

(c) A colorant without the above-mentioned problems is dispersed in a monomer and the resultant mixture is suspension-polymerized in a solvent which does not substantially dissolve the monomer, whereby polymer particles produced from the monomer, and containing the colorant may be obtained. In such suspension polymerization, an inorganic dispersant such as silica and calcium phosphate is used as the dispersant. The dispersant may preferably be removed from the polymer fine particles by washing with water or a treatment with acid or alkali. However, the polymer particles ma be used without removing the dispersant in a case where practically no problem occurs.

As the colorant used in the present invention, known carbon black, pigments or dyes may be used.

Examples of the dyes may include: C.I. Direct Red 1, C.I. Direct Red 4, C.I. Acid Red 1, C.I. Basic Red 1, C.I. Mordant Red 30, C.I. Direct Blue 1, C.I. Direct Blue 2, C.I. Acid Blue 9, C.I. Acid Blue 15, C.I. Basic Blue 3, C.I. Basic Blue 5, and C.I. Mordant Blue 7.

Examples of the pigments may include; Naphthol Yellow S, Hansa Yellow G, Permanent Yellow NCG, Permanent Orange GTR, Pyrazolone Orange, Benzidine Orange G, Permanent Red 4R, Watching Red calcium salt, Brilliant Carmine 3B, Fast Violet B, Methyl Violet Lake, Phthalocyanine Blue, Fast Sky Blue, and Indanthrene Blue BC.

Particularly preferred pigments may include disazo yellow pigments insoluble azo pigments and copper phthalocyanine pigments, and particularly preferred dyes may include basic dyes and oil-soluble dyes.

Particularly preferred examples may include: C.I. Pigment Yellow 17, C.I. Pigment Yellow 15, C.I. Pigment Yellow 13, C.I. Pigment Yellow 14, C.I. Pigment Yellow 12, C.I. Pigment Red 5, C.I. Pigment Red 3, C.I. Pigment Red 2, C.I. Pigment Red 6, C.I. Pigment Red 7, C.I. Pigment Blue 15, C.I. Pigment Blue 16, copper phthalocyanine pigments having two to three carboxybenzamidomethyl groups, and copper phthalocyanine pigments represented by the following structural formulas such as one represented by the following formula (I), which has a phthalocyanine skeleton to which 2–3 carboxybenzamidomethyl group in the form of Ba salts are attached.

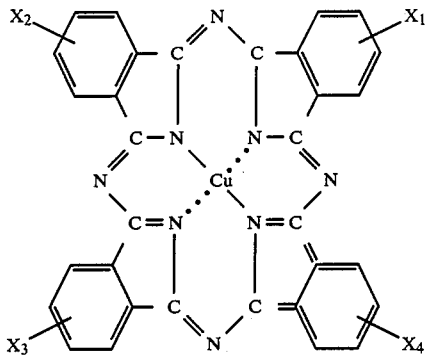

wherein $X_1$–$X_4$ respectively denote

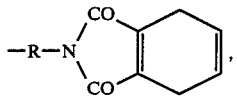

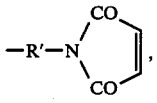

or -H, wherein R and R′ denote an alkylene group having 1–5 carbon atoms, while all of $X_1$–$X_4$ are not simultaneously hydrogen atoms (—H);

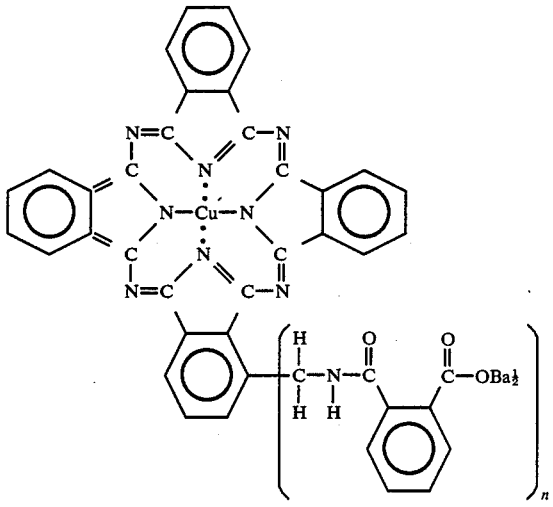

n = 2 – 3

Particularly preferred examples of dyes may include: C.I. Solvent Red 49, C.I. Solvent Red 52, C.I. Solvent Red 109, C.I. Basic Red 12, C.I. Basic Red 1, and C.I. Basic Red 3B.

Then, there will be described an embodiment of the process according to the present invention, wherein modifier particles (B2) comprising a charge controller are fixed to the surfaces of resinous base particles (A).

In the toner obtained in the present invention, the charge controller is firmly fixed to the surfaces of the toner particles and is evenly and stably imparted or distributed to the individual toner particles, whereby the triboelectric charge may be imparted extremely evenly to the toner particles. On the contrary, in a case where a charge controller and base particles for toner are simply mixed uniformly, the charge controller attached to the toner surfaces is easily freed in successive copying, whereby the charge controller contaminates carrier particles or a toner-carrying member, whereby the triboelectric charge of the toner gradually decreases. As a result, the image density undesirably decreases and image fog undesirably increases. Also in case of the conventional toner obtained by melt-kneading, pulverization and classification, a part of the charge controller is sometimes weakly attached to the toner surfaces. In such case, the charge controller is liable to be freed from the toner and to contaminate carrier particles or a toner-carrying member. Originally, it is sufficient that a charge controller is present only at the surfaces of the toner particles, in view of the function thereof. Accordingly, the charge controller present in the interior of toner particles may be considered to be substantially useless. Further, in the toner produced by the conventional process, it is considered that only a part of the charge controller added to the toner (i.e., the charge controller present at the surfaces of toner particles) may practically be used and the most thereof is useless. Further, it is difficult to control the amount of the charge controller present in the surface portion of the toner particles.

Generally, there is a difference between the dispersibility of the binder resin in the melt-kneading and that of the charge controller, and the dispersibility varies depending on the method of melt-kneading. While there may for example be considered a method wherein the melt-kneading temperature is lowered to enhance the dispersibility of the charge controller, the polymer chains of the polymer constituting the binder resin tend to be cleaved and the dispersibility of the colorant tends to decrease in such method. As a result, a melt-kneading method suitable for the charge controller is not necessarily adopted. Therefore, since the resinous mixture is cleaved in different manners under the action of an impact force exerted in the pulverization step, there varies the amount of the charge controller present in the surface portion of the resultant tone particles.

In the case of a toner obtained through suspension polymerization, similarly as in the above-mentioned toner obtained by melt-kneading and pulverization, it is difficult to control the amount of the charge controller present in the surface portion of the toner particle, in view of the dispersibility of the charge controller. Therefore, also in this case, it is considered that only a part of the charge controller added to the toner may practically be used and the most thereof is useless.

Particularly, in this method, the charge controller may sometimes be one capable of inhibiting the polymerization such as a metal complex of a nigrosine-type monoazo dye, and it is sometimes difficult to use a large amount of such charge controller. Further, it is sometimes difficult to use a charge controller which is hydrolyzable or decomposable by a monomer, or strongly hydrophilic, since the charge-controlling property thereof is liable to disappear, or it tends to broadene the particle size distribution of the toner or to promote the production of fine toner particles. Moreover, a capsule toner wherein the surface of a core material is coated with a resinous substance, has been prepared mainly by a coating method using a resin solution, but it is not necessarily easy to solve the problem of deviation of a charge controller.

On the contrary, in the present invention, modifier particle (B2) having a charge-controlling property are fixed onto resinous base particles (A) under the action of a mechanical impact force in powdery states. The modifier particles (B2) may preferably be fixed to partial surfaces of the base particles (A) as described hereinafter. Incidentally, in a case where the resinous base particles (A) are substantially colored, such base particles (A) are sometimes referred to as "colored base particles (A2)".

Incidentally, in a insulating toner, it is important to adjust the triboelectric charge thereof to a constant value. In order to obtain good images under different environmental conditions, and to obtain good images, which are not substantially different from the initial image, in successive image formation, it is important how to control the triboelectric charge of the toner.

Generally speaking, when the rise in the triboelectric charge of the toner is intended to be sharper, the absolute amount thereof is liable to be too large. Therefore, particularly under a low-humidity condition, it is necessary to generate an intense electric field in order to transfer the toner having an excessive triboelectric charge to a latent image-bearing surface. As a result, there is caused a load on the system or a risk of discharge due to a dielectric breakdown.

On the other hand, when the charging characteristic of the toner is suppressed, particularly under a high-humidity condition, the period of time for toner to have a sufficient amount of charge is prolonged thereby to cause a problem. More specifically, there cannot be excluded toner particles which attach to a portion other than a latent image portion of an image-bearing member under the action of a force other than an electric force. As a result, such toner particles contaminate the resultant toner image. However, in the present invention, the above-mentioned problem may be solved by fixing modifier particles (B2) having a charge-controlling property to partial surfaces of colored base particles (A2). In the present invention, the triboelectric charge may suitably be controlled by evenly imparting a charge controller to partial surfaces of toner particles. On the other hand, in a case where the modifier particles (B2) having a charge-controlling property are present on the entire surfaces of the toner particles, it is considered that the absolute amount of the triboelectric charge (i.e., the absolute value of the triboelectric charge) is excessively increased.

In the present invention, the modifier particles (B2) having a charge-controlling property are fixed to the base particles (A) under the action of a mechanical impact force. As a result, the modifier particles are not substantially freed from the base particles, and both the modifier particles and the base particles function as the unity of a toner, in the sequential steps, e.g., a step wherein an external additive such as silica is mixed with the toner and under stirring, or a step wherein the toner is stirred or rubbed in order to develop a latent image. In the present invention, the amount of the charge controller present in the surface portions of the toner particles may be controlled by the addition amount thereof, and the charge controller is evenly imparted or distributed to the toner particles. As a result, when the toner obtained in the present invention is used, a uniform triboelectric charge amount may constantly be obtained even in successive copying, and therefore images having a constant image density and a stable image quality may be obtained.

In the present invention, since the charge controller may be imparted only to the surface portion of the toner particle, the charge controller can be added to the toner in an amount of 1/5 or less (e.g., about 1/10) of that in the conventional method. Further, in the toner obtained in the present invention, since the charge controller is fixed to the surfaces of the toner particles, it rarely contaminates carrier particles or a toner-carrying member such as a sleeve, whereby a good developing characteristic may be obtained.

As the modifier particles (B2) having a charge-controlling property, there may be used either particles of a charge controller per se or resinous particles obtained by dispersing a charge controller in a resin.

The ratio of volume-average particle size of the modifier particles (B2) to that of the colored base particles (A2) may preferably be 0.2 or less, more preferably 0.001–0.15. If the ratio between the volume-average particle sizes is above 0.2, it is difficult to uniformly fix the modifier particles (B2) to the surfaces of the colored base particles (A2).

In this embodiment, the coverage of the base particles (A2) with the modifier particles (B2), i.e., the proportion of the surface areas of base particles (A2) covered with the modifier particles (B2) to the total surface areas of the base particles (A2), is calculated in the same manner as in the case of the above-mentioned base particles (A1) and modifier particles (B1).

The coverage of the colored base particles (A2) with the modifier particles (B2) may preferably be 0.1–50%. More specifically, in the case of modifier particles (B2) are substantially composed of a charge controller per se, the coverage may preferably be 0.1–10%, more preferably 0.2–5%. In the case of a modifier particle (B2) comprising a charge controller and resinous component, the coverage may preferably be 0.2–50%, more preferably 0.4–40%. Incidentally, the modifier particles (B2) may preferably be used in an amount of 0.01–20wt. parts, per 100 wt. parts of the base particles (A2).

If the coverage is below 0.1%, the charge-controlling property may be insufficient. On the other hand, if the coverage is above 50%, the absolute triboelectric charge amount of the toner may excessively be increased whereby the image density of a toner image tends to be lowered.

In an embodiment of the present invention wherein the colored modifier particle (B1) is the same as or equivalent to the charge-controlling modifier particle (B2) in view of the materials thereof, the modifier particle (B is used as the charge-controlling modifier particle priot to the colored modifier particle. Accordingly, in a case where the colored modifier particle (B1) can be used as the charge-controlling modifier particle (B2), the coverage may generally preferably be 0.1–50%.

The charge controller usable in the present invention refers to a substance having the following triboelectrical charging characteristic.

100 wt. parts of a bulk-polymerized product of a polystyrene resin (weight-average molecular weight: about 100,000–200,000) and 5 wt. parts of a charge controller are sufficiently melt-kneaded (e.g., for about 30 min.–1 hour) by means of a hot roller at a temperature of 100°–150° C., and then cooled, pulverized, and classified thereby to prepare polystyrene particles having a mode particle size of 10 μm and containing the charge controller.

About 5 g of the thus prepared polystyrene particles and 95 g of carrier iron powder having a mode particle size of 200–300 mesh, which is not covered with a resin (.e.g, EFV 200/300, mfd. by Nihon Teppun K.K.) are left standing overnight under conditions of 25° C. and 50–60% RH. Thereafter, the polystyrene particles and the iron powder and sufficiently mixed (for about 5–10 min.) in a polyethylene container having a volume of about 200 cc, and the triboelectric charge of the charge controller is measured by using an aluminum cell with a 400 meshscreen according to an ordinary below-off method. The charge controller usable in the present invention is one having the thus measured triboelectric charge of 3 μc/g or more, particularly 7 μc/g or more, in terms of the absolute value thereof.

Further, the modifier particles (B2) may preferably have a triboelectric chargeability such that the absolute amount of the triboelectric charge measured by the above-mentioned below-off method is 3 μm/g or above.

As the charge controller to be used in the toner of the present invention, positive or negative charge controllers which are solid at least in a temperature range of 20°–90° C. can be used. Examples of charge controllers used in the present invention may include those as set forth below.

(1) As the controller which controls the toner to be positively chargeable, the following substances may be included:

nigrosin; azine dyes having an alkyl group containing 2–16 carbon atoms (as disclosed in Japanese Patent Publication (JP-B, Kokoku) No. 1627/1967); basic dyes including, e.g., C.I. Basic Yellow 2 (C.I. 41000), C.I. Basic Yellow 3, C.I. Basic Red 1 (C.I. 45160), C.I. Basic Red 9 (C.I. 42500), C.I. Basic Violet 1 (C.I. 42535), C.I. Basic Violet 3 (C.I. 42555), C.I. Basic Violet 10 (C.I. 45170), C.I. Basic Violet 14 (C.I. 42510), C.I. Basic Blue 1 (C.I. 42025), C.I. Basic Blue 3 (C.I. 51005), C.I. Basic Blue 5 (C.I. 42140), C.I. Basic Blue 7 (C.I. 42595), C.I. Basic Blue 9 (C.I. 52015), C.I. Basic Blue 24 (C.I. 52030), C.I. Basic BLue 25 (C.I. 52025), C.I. Basic Blue 26 (C.I. 44045), C.I. Basic Green 1 (C.I. 42040), C.I. Basic Green 4 (C.I. 42000); lake pigments of these basic dyes (lake-forming agent may be phosphotungstic acid, phosphomolybdic acid, phosphotungustomolybdic acid, tannic acid, lauric acid, gallic acid, ferricyanide, ferrocyanide); C.I. Solvent Black 3 (C.I. 26150), Hansa Yellow G (C.I. 11680), C.I. Mordant Black 11, C.I. Pigment Black 1, benzylmethyl-hexadecylammonium chloride and decyltrimethylammonium chloride; dialkyltin compounds having groups such as dibutyl and dioctyl; dialkyltin borate compounds; guanidine derivative; vinyl polymers having an amino group; polyamine resins such as condensation-polymerized polymer having an amino group.

(2) As the controller which controls a toner to be negatively chargeable, the following substances may be included:

metal complex compounds of monoazo dyes as disclosed in Japanese Patent Publication (Kokoku) Nos. 20153/1966, 27596/1968, 6397/1969, 26478/1970;

metal complex compounds containing a Zn, Al, Co, Cr or Fe atom and salicylic acid, dialkylsalicylic acid, naphthoic acid or dicarboxylic acids as disclosed in Japanese Patent Publication (kokoku) Nos. 42752/1980, 41508/1983, 7384/1983 and 7385/1984; and sulfonated copper phthalocyanine pigments.

Further, it is preferred that the charge controller used in the present invention has characteristics of little environmental dependence, thermal stability, mechanical stability and chemical stability.

The resin to be used in the modifier particles (B1) and (B2) may be an ordinary binder resin for toner. Examples thereof include: homopolymers os styrene and substituted derivatives thereof such as polystyrene; styrene copolymers such as styrene-acrylic acid ester copolymer, styrene-methacrylic acid ester copolymer, styrene-acrylonitrile copolymer, styrene-butadiene copolymer, styrene-isoprene copolymer, and styrene-acrylonitrile-indene copolymer; acrylic resins, methacrylic resins, silicone resins, polyester resins, furan resins, and epoxy resins.

In the present invention, there may preferably be used a crosslinked styrene copolymer or polyester. Examples of comonomers to be copolymerized in the above-mentioned styrene copolymer include: monocarboxylic acids having a double bond or thereof such as acrylic acid, methyl acrylate, ethyl acrylate, butyl acrylate, dodecyl acrylate, thereof octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile, and acrylamide; dicarboxylic acids having a double bond or derivatives thereof such as maleic acid, butyl maleate methyl maleate, and dimethyl maleate.

Further, there may mainly be used a compound having two or more polymerizable double bonds, as the crosslinking agent. Examples of such crosslinking agent may include: aromatic divinyl compounds such as divinylbenzene and divinylnaphthalene; carboxylic acid esters having two double bonds such as ethylene glycol diacrylate, ethylene glycol dimethacrylate, and 1,3-butanediol dimethacrylate; divinyl compounds such as divinylaniline, divinyl ether, divinyl sulfide and divinyl sulfone; and compounds having 3 or more vinyl groups. These compounds may be used singly or as a mixture.

The above-mentioned resin may preferably have a Tg (glass transition temperature) of 50° C. or above, more preferably 55° C. or above, in view of the so-called anti-blocking characteristic in long-period storage. In a case where the particle size of the charge controller (or the colorant) particles or aggregates thereof is relatively large, it is preferred that the charge controller (or the colorant) and the resin are melt-kneaded and pulverized, because such charge controller or colorant may be dispersed in the resin to obtain fine particles having a relatively small particle size. More specifically, even when the ratio of the particle size of such particles (or aggregates) to that of the base particles (A) is above 0.2, there may effectively be obtained modifier particles such that the above mentioned ratio is 0.2 or below, in such manner.

Further, the weight ratio of the charge controller to the resin (charge-controller/resin) may preferably be 50/50 to 1/99, more preferably 20/80 to 1/99.

The resinous modifier particles (B2) comprising a charge controller may be prepared in the following manner.

(a) The charge controller and a resin are meltkneaded, cooled and pulverized in an general manner to obtain fine particles. As desired, the pulverized product may be classified to obtain fine particles having a desirable particle size.

In a case where the charge controller is a resinous substance, such resin may be pulverized in a general manner to obtain fine particles. As desired, the pulverized product may be classified to obtain desirable fine particles. Further, such fine particles may be obtained by the hot-spray method.

(b) A monomer is suspension-polymerized in the presence of a charge controller without the above-mentioned problems in an organic solvent which dissolves the monomer but does not dissolve the polymer produced from the monomer, whereby fine polymer particles containing the charge controller are prepared. Fine particles may be obtained by removing the solvent from the reaction product.

(c) A charge controller without the above-mentioned problems is dispersed in a monomer and suspension-polymerized in a solvent which does not substantially dissolve the monomer, whereby polymer particles produced from the monomer and containing the charge controller ma be obtained. In such suspension polymerization, an inorganic dispersant such as silica and calcium phosphate is used as the dispersant. The dispersant may preferably be removed from the polymer fine particles by washing with water or a treatment with acid or alkali. However, the polymer particles may be used without removing the dispersant in a case where practically no problem occurs.

In a case where the modifier particles (B) (i.e., particles (B1) or (B2)) are prepared through suspension polymerization, the polymerizable monomer applicable to the present invention may be those having a vinyl group ($CH_2{=}C<$). Examples thereof include: styrene; styrene derivatives such as o-methylstyrene, m-methylstyrene, p-methylstyrene, p-methoxystyrene, and p-ethylstyrene; acrylic acid methacrylic acid, maleic acid and maleic acid half esters; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and monomers having a reactive double bond such as derivatives of acrylic acid or methacrylic acid including acrylonitrile, methacrylonitrile, and acrylamide. These monomers may be used either singly or in mixture of two or more species.

In the present invention, a crosslinking agent may be used, as desired. Examples of the crosslinking agent may include: divinylbenzene, divinylnaphthalane, diethyleneglycol dimethacrylate, and ethylene glycol dimethacrylate. The amount of use of the crosslinking agent may suitably be 0.1–5 wt. parts, per 100 wt. parts of the polymerizable monomer.

Further, a polymer of the above-mentioned polymerizable monomer may be added to a polymerizable monomer composition to be suspension-polymerized, in a relatively small amount. In the present invention, it is preferred to use modifier particles (B) produced from styrene, a styrene derivative having a substituent such as an alkyl group, or a monomer mixture of styrene and another monomer, in view of the developing characteristics and durability of the resultant toner.

On the other hand, the base particles (A) (i.e., the colorless particles (A1) or the colored particles (A2)), may for example be prepared in the following manner.

A composition comprising at least a binder resin (and an optional release agent, as desired) is melt-kneaded, cooled, and pulverized by means of a general pulverizer thereby to prepare base particles (A). The thus prepared base particles (A) may be classified to adjust the particle size thereof, as desired. In order to obtain a toner for development, the volume-average particle size of the base particles (A) may preferably be 2–20 μm.

The binder resin for toner to be used in the base particle (A) may include: homopolymers of styrene and substituted derivatives thereof such as polystyrene; styrene copolymers such as styrene-acrylic acid ester copolymer, styrene-methacrylic acid ester copolymer, styrene-acrylonitrile copolymer, styrenebutadiene copolymer, styrene-isoprene copolymer, and styrene-acrylonitrile-indene copolymer; acrylic resins, methacrylic resins, silicone resins, polyester resins, epoxy resins, etc.

In the present invention, there may preferably be used a crosslinked styrene copolymer or polyester. Examples of comonomers to be copolymerised in the above-mentioned styrene copolymer include: monocarboxylic acids having a double bond or derivatives thereof such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl mechacrylate, acrylonitrile, methacrylonitrile, and acrylamide; dicarboxylic acids having a double bond or derivatives thereof such as maleic acid, butyl maleate, methyl maleate, and dimethyl maleate. These vinyl monomers may be used singly or as a mixture of two or more species.

Further, there may mainly be used a compound having two or more polymerizable double bonds, as the crosslinking agent. Examples of such crosslinking agent may include: aromatic divinyl compounds such as divinylbenzene and divinylnaphthalene; carboxylic acid esters having two double bonds such as ethylene glycol diacrylate, ethylene glycol dimethacrylate, and 1,3-butanediol dimethacrylate; divinyl compounds such as divinylaniline, divinyl ether, divinyl sulfide and divinyl sulfone; and compounds having 3 or more vinyl groups. These compounds may be used singly or as a mixture.

The base particles (A) prepared through suspension polymerization may preferably have a spherical shape due to the production process thereof. Therefore, such base particles (A) may preferably be used since it is easy to evenly fix modifier particles (B) thereto. Further, these base particles (A) are produced without a pulverization step and free of the fusion or agglomeration which can occur in the pulverization step, and therefore the material constituting such base particles (A) may suitably be selected from a wide scope therefor.

The above-mentioned base particles (A) due to polymerization may for example be prepared in the following manner.

A polymerizable monomer composition comprising at least a polymerizable monomer and a polymerization initiator (optionally, further comprising an additive such as a crosslinking agent, a charge controller, or a polar polymer, as described below) is charged into an aqueous phase (i.e., a continuous phase) containing a suspension stabilizer, the polymerizable monomer composition is formed into particles under stirring and is polymerized to form polymer particles.

Then, the suspension stabilizer is removed from the reaction product, as desired, and the resultant reaction product is subjected to filtration and drying thereby to prepare base particles (A).

It is particularly preferred to obtain the base particles (A) through a suspension polymerization method as described below, because the resultant base particles (A) may have a sharp particle size distribution.

In a case where the base particles (A) are prepared through suspension polymerization, the polymerizable monomer applicable to the present invention may be those having a vinyl group ($CH_2{=}C<$). Examples thereof, similarly as in the case of the modifier particles (B), include: styrene; styrene derivatives such as o-methylstyrene, m-methylstyrene, p-methylstyrene, p-methoxystyrene, and p-ethylstyrene; acrylic acid methacrylic acid, maleic acid and maleic acid half esters; $\alpha$-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; and monomers having a reactive double bond such as derivatives of acrylic acid or methacrylic acid including acrylonitrile, methacrylonitrile, and acrylamide. These monomers may be used either singly or in mixture of two or more species.

In the present invention, a crosslinking agent may be used, as desired. Examples of the crosslinking agent may include: divinylbenzene, divinylnaphthalane, diethylene glycol dimethacrylate, and ethylene glycol dimethacrylate. The amount of use of the crosslinking agent may suitably be 0.1–5 wt. parts, per 100 wt. parts of the polymerizable monomer.

Further, a polymer of the above-mentioned polymerizable monomer may be added to a polymerizable monomer composition in a relatively small amount. In the present invention, it is preferred to use base particles (A) produced from styrene, a styrene derivative having a substituent such as an alkyl group, or a monomer mixture of styrene and another monomer, in view of the developing characteristics and durability of the resultant toner.

If a polar polymer (inclusive of copolymer) or cyclized rubber is added to a polymerizable monomer to be polymerized, preferable base particles (A) having a pseudo-capsule structure can be obtained. The polar polymer or cyclic rubber may preferably be added in an amount of 0.5–50 wt. parts, preferably 1–40 wt. parts, per 100 wt. parts of the polymerizable monomer. Below 0.5 wt. part, it is difficult to obtain a desired pseudo-capsule structure. Above 50 wt. parts, there arises an increased tendency that the characteristics of the toner are lowered because the amount of the polymerizable monomer becomes insufficient. It is preferred that a polymerizable monomer composition containing the polar polymer or cyclized rubber thus added is suspended in an aqueous medium containing a dispersant dispersed therein having a chargeability to a polarity opposite to that of the polar polymer.

The cationic polymer (inclusive of copolymer), anionic polymer (inclusive of copolymer) or anionic cyclized rubber thus contained in the polymerizable monomer composition exerts an electrostatic force at the surface of toner-forming particles with the oppositely chargeable anionic or cationic dispersant dispersed in the aqueous medium, so that the dispersant covers the surface of the particles to prevent coalescence of the particles with each other and to stabilize the dispersion. In addition, as the added polar polymer or cyclized rubber gathers at the surface layer of the particles, a sort of shell is formed to provide the particles with a pseudo-capsule structure. The polar polymer or cyclized rubber of a relatively large molecular weight thus gathered at the particle surfaces may envelop a large amount of the low-softening point compound inside thereof to provide the base particles with excellent anti-blocking characteristic, developing characteristic and abrasion resistance. Examples of the polar polymer (inclusive of copolymer and cyclized rubber) and the dispersant or dispersion stabilizer having a chargeability usable in the present invention may be raised hereinbelow. The polar polymer having a weight-average molecular weight of 5,000–500,000 as measured by GPC (gel permeation chromatography) is preferred because of good solubility in the polymerizable monomer and characteristic of providing a durable toner.

(a) Cationic polymers: polymers of nitrogen-containing monomers such as dimethylaminoethyl methacrylate and diethylaminoethyl acrylate; copolymers of styrene and such a nitrogen-containing monomer; and a ternary copolymer of styrene, an unsaturated carboxylic acid ester and such a nitrogen-containing monomer.

(b) Anionic polymers: polymers or copolymers of anionic monomers inclusive of nitrile monomers such as acrylonitrile, halogen-containing monomers such as vinyl chloride, unsaturated carboxylic acid such as acrylic acid, unsaturated dibasic acids, and unsaturated dibasic acid anhydrides; and copolymers of styrene and such an anionic monomer. Cyclized rubber may also be used as an anionic polymer.

The dispersant may preferably be hardly water-soluble or substantially water-insoluble inorganic fine powder capable of stabilizing the dispersion of the monomer composition particles in an aqueous medium. The amount of addition of the dispersant may preferably be 0.1–50 wt. %, particularly 1–20 wt. %, based on the water.

(c) Anionic dispersant: colloidal silica such as Aerosil #200, #300 (Nihon Aerosil K.K.).

(d) Cationic dispersant: aluminum oxide, magnesium hydroxide and hydrophilic positively chargeable silica fine powder such as aminoalkylmodified colloidal silica obtained through treatment with a coupling agent.

In order to produce base particles (A) containing a magnetic material, magnetic particles are added into the monomer composition. In this case, the magnetic particles also function as a colorant. The magnetic particles usable in the present invention may be a substance magnetizable when placed in a magnetic field, such as powder of a ferromagnetic metal such as iron, cobalt and nickel, or an alloy or compound thereof such as magnetite, hematite and ferrite. The magnetic particles may generally have a particle size of 0.05–5 microns, preferably 0.1–1 micron, more preferably 0.1–0.5 micron. The content of the magnetic particles may suitably be 10–65 wt. %, preferably 10–60 wt. %, more preferably 20–50 wt. %, based on the weight of the base particle. It is possible that the magnetic particles have been treated with a treating agent such as silane coupling agent or titanate coupling agent or with an appropriate reactive resin. In this case, while also depending on the surface area of the magnetic particles or the density of the hydroxyl group present at the surface thereof, a treating amount of 5 wt. % or less, preferably 0.1–3 wt. %, may provide a sufficient dispersibility in the polymerizable monomer and a low-softening point compound as described below, whereby a bad influence is not exerted on the properties of the base particles (A).

The monomer composition may contain a colorant. The colorant may comprise known dyes or pigments such as carbon black or grafted carbon black obtained by coating the surface of carbon black with a resin. The colorant may be contained in a proportion of 0.5–30 wt. % based on the total weight of the polymerizable monomer and the low-softening point compound. It is possible to add a charge controller, a fluidity improver, or a release agent, as desired, into the base particle (internal addition).

In the suspension polymerization, a monomer composition comprising a polymerizable monomer and an optional additive such as colorant (and further a polymerization initiator, as desired) in a uniformly dissolved or dispersed state is dispersed in an aqueous medium, e.g., heated to a temperature which is 5° C. or more, preferably 10°–30° C., higher than a subsequent polymerization temperature and containing 0.1–50 wt. % of a suspension stabilizer (e.g., hardly water-soluble inorganic dispersant) under stirring by means of an ordinary stirrer or a high-shearing force stirrer such as homomixer and homogenizer. Preferably, the speed and time for stirring and the temperature of the aqueous medium may be adjusted so that the droplets of the melted or softened monomer composition have a desired toner particle size of 30 microns or below (e.g., 0.1–20 microns in terms of a volume-average particle size). After that, while stirring is effected to such an extent that the dispersion state is substantially maintained as such because of the function of the dispersion stabilizer, while preventing the sedimentation, the temperature of the aqueous medium is lowered to the polymerization temperature. The polymerization temperature may be set to a temperature of 50° C. or above, preferably 55°–80° C., particularly preferably 60°–75° C. While continuing the stirring, a substantially water-insoluble polymerization initiator is added to the system to effect polymerization. After the completion of the reaction, the resultant polymer particles are washed, recovered by an appropriate method such as filtration, decantation and/or centrifugation, and dried, thereby to obtain a base particles (A) usable in the present invention. In the suspension polymerization, 200–3000 wt. parts of water is ordinarily used as an aqueous dispersion medium with respect to 100 wt. parts of the total weight of the polymerizable monomer and the low-softening point compound.

As another method for forming the base particles (A), there may be used a method wherein a material in a melted state is formed into fine particles. Examples of such method may include various known methods of forming a liquid into fine droplets. More specifically, there may be used a method using a single fluid nozzle using a pressure, a dual fluid nozzle using a high-pressure gas stream, or a disk atomizer using a rotating disk.

In order to prepare base particles (A) to be used for a heat-fixing system, the binder resin thereof may preferably have a softening point measured by the following method of 90°–150° C., more preferably 90°–140° C.

Flow Tester Model CFT-500 (available from Shimazu Seisakusho K.K.) is used. Powder having passed through a 60-mesh sieve is used as a sample and weighed as about 1.0 to 1.5 g. The sample is pressed under a pressure of 100 kg/cm$^2$ for 1 minute by using a tablet shaper.

The pressed sample is subjected to measurement by means of Flow Tester under the following conditions:

RATE TEMP: 6.0 D/M (°C./min)
SET TEMP: 50.0 DEG (°C.)
MAX TEMP: 200.0 DEG
INTERVAL: 2.5 DEG
PREHEAT: 300.0 SEC
LOAD: 20.0 KGF (kg)
DIE (DIA): 0.5 MM (mm)
DIE (LENG): 1.0 MM
PLUNGER: 1.0 CM$^2$ (cm$^2$)

From the above measurement, the softening temperature of the sample is defined as the temperature corresponding to ½ of the stroke difference (of the piston placed on the sample) of from the resultant flow-initiation temperature to the flow-termination temperature of the sample.

Further, in a case where the toner obtained in the present invention is used in an image-forming method using hot-roller fixing device, the toner may preferably contain a release agent having a releasing property.

Examples of the release agent may include those as described below, but are not restricted thereto. The release agent may preferably be a low-softening point substance having a softening point measured by the ring and ball method (as described in JIS K 2531) of 40°–130° C., more preferably 50°–120° C. If the softening point is below 40° C., the anti-blocking property and the shape-retaining property of the toner may be insufficient. On the other hand, if the softening point is above 130° C., the effect in reducing a fixing temperature or a fixing pressure is a little.

Examples of such low-softening point compound include paraffin waxes, low-molecular weight polyolefins, modified waxes having an aromatic group, hydrocarbon compounds having an alicyclic group, natural waxes, long-chain carboxylic acids having a long hydrocarbon chain ($CH_3$–$(CH_2)_{11}$ or –$(CH_2)_{12}$ or a longer aliphatic chain) including 12 or more carbon atoms, esters and metal salts thereof, fatty acid amides and fatty acid bisamides. A mixture of different low-softening point compounds may be mixed. The low-softening point compound may preferably be contained in an amount of 1–100 wt. parts, per 100 wt. parts of the binder resin.

More specifically, examples of commercially available products include Paraffin Wax (Nihon Sekiyu K.K.), Paraffin Wax (Nihon Seiro K.K.), Microwax (Nihon Sekiyu K.K.), Microcrystalline Wax (Nihon Seiro K.K.), PE-130 (Hoechst), Mitsui Hi-Wax 110P (Mitsui Sekiyu Kagaku K.K.), Mitsui Hi-Wax 220P (ditto), Mitsui Hi-Wax 660P (ditto), Mitsui Hi-Wax 210P (ditto), Mitsui Hi-Wax 320P (ditto), Mitsui Hi-Wax 410P (ditto), Mitsui Hi-Wax 420P (ditto), Modified Wax JC-1141 (ditto), Modified Wax JC-2130 (ditto), Modified Wax JC-4020 (ditto), Modified Wax JC-1142 (ditto), Modified Wax JC-5020 (ditto); bees wax, carnauba wax, and montan wax.

On the other hand, examples of the fatty acid metal salt may include: zinc stearate, calcium stearate, magnesium stearate, zinc oleate, zinc palmitate, and magnesium palmitate.

In a case where a pressure-fixable capsule toner is produced, the resin used in the base particles (A) may include: waxes such as polyethylene wax, oxidized polyethylene, paraffin, fatty acids, fatty acid esters, fatty acid amides, fatty acid metal salts, and higher alcohols; and resins such as ethylene-vinyl acetate resins and cyclized rubbers. These materials may for example be mixed under heating and may be formed into fine particles in a melted state. Examples of such method may include various known methods of forming a liquid into fine droplets. More specifically, there may be used a method using a single fluid nozzle using a pressure, a dual fluid nozzle using a high-temperature gas stream, or a disk atomizer using a rotating disk. Fine particles may be produced by melting such material under heating in a solvent, and cooling the resultant mixture. In this case, a dispersant may be used under stirring, and the dispersant may preferably be removed, as desired, by washing with water, or a treatment with acid or alkali. Such granulating method is preferred because it may provide spherical particles.

The substance forming the wall (or shell of the capsule may include: styren-type resin (i.e., homopolymers or copolymers comprising styrene or a substituted styrene derivative) such as polystyrene, poly-α-methylstyrene, styrene-propylene copolymer, styrene-butadiene copolymer, styrene-vinyl chloride copolymer, styrene-maleic acid copolymer, styrene-acrylic acid ester copolymers (such as styrene-methyl acrylate copolymer, styrene-ethyl acrylate copolymer, styrene-butyl acrylate copolymer, styrene-octyl acrylate copolymer, and phenyl acrylate copolymer), styrene-methacrylic acid ester copolymer (such as styrene-methyl methacrylate copolymer, styrene-ethyl methacrylate copolymer, styrene-butyl methacrylate copolymer, and styrene-phenyl methacrylate copolymer), and styrene-acrylonitrile-acrylic acid ester copolymer; rosin-modified maleic acid resins, epoxy resins, polyester resins, ionomer resins, ketone resins, and xylene resins.

As the method for forming a capsule wall, there may preferably be used a method wherein the solubility characteristic of the above-mentioned wall material is changed in a solvent wherein the wall material is soluble but a core material to be encapsulated is substantially insoluble. For example, there may preferably be used a phase-separation method wherein a poor solvent is dropped into a solution of a wall material thereby to deposit the wall material, on the core material. In the present invention, the thus prepared capsules may be used as the base particles (A).

Hereinbelow, there will be described a preferred embodiment of the process according to the present invention, but the present invention is not restricted thereto.

In such embodiment, the fixing process comprises a pretreatment step wherein modifier particles (B) are dispersed in the base particles (A) to uniformly attach the modifier particles to the base particles, and a fixing step wherein the attached modifier particles are fixed to the base particles (A) under the action of an impact force.

In the pretreatment step, the modifier particles (B), while dispersed in the base particles (A), are rubbed therewith whereby the modifier particles (B) are attached to the base particles under the action of an electrostatic force (and a Van der Waals force). In this step, a mixer having a stirring vane rotatable at a high speed may generally be used, but a mixer used in this step is not restricted thereto. More specifically, another mixer may be used as far as it has a mixing function and a dispersing function.

FIG. 1 shows an embodiment of a mixer (Henchel mixer) having a high-speed stirring vane, which is used in the pretreatment, which is used in the pretreatment. The mixer shown in FIG. 1 comprises a jacket 1, a stirring vane 2, a motor 3 for driving the stirring vane, a lid 4, a base 5, a control plate 6 for collision with powder, a cylinder 7 for lifting the lid, a locking device for the lid, a cylinder 9, a direction control unit 10 for changing the angle of the control plate, and a discharge port 11.

In the pretreatment, it is required that both the base particles (A) and the modifier particles (B) are sufficiently dispersed, and that the base particles (A) are not substantially pulverized. In the pretreatment, in consideration of the physical properties of a material for toner, the following conditions may preferably be used: a treatment temperature (ambient temperature) of 0°–50° C., more preferably 10°–40° C., which is preferably lower than the softening points of the base particles and the modifier particles; a peripheral speed at the tip of a stirring vane of 5–50 m/sec; a treatment time of 1 min–60 min; the length of a stirring vane of 10–100 cm, which is preferable in view of mixing efficiency and the prevention of the pulverization. Further, in this treatment, the treatment chamber may preferably be cooled by means of a jacket or cooling air, because the stirring may elevate the temperature.

As the device for the pretreatment, in addition to the above-mentioned mixer having a high-speed stirring vane, there may be used a device which has a dispersing and a mixing functions and can provide a sufficiently long residence time. More specifically, there may be used a machine such as a pulverizer or a vibration mill, while reducing the impact force thereof so as to satisfy the above-mentioned conditions. Further, modifier particles (B) may be dispersed in a liquid containing base particles (A), and then the resultant mixture may be subjected to filtration, drying and fixing.

In the above-mentioned pretreatment wherein the modifier particles (B) are uniformly attached to the base particles (A), the fluidity or flowability and the dispersibility of the modifier particles (B) are important. If the modifier particles (B) are strongly aggregated, they cannot be formed into the individual particles in the pretreatment step, whereby the uniform attachment of the modifier particles (B) to the base particles (A) tends to be difficult. Similarly, if the fluidity of the modifier particles (B) is extremely poor, they cannot be formed into the individual particles in the pretreatment step, whereby the uniform attachment of the modifier particles (B) to the base particles (A) tends to be difficult. In the case of the modifier particles (B) having a relatively poor fluidity and dispersibility, it is particularly preferred that silica fine powder is added to the modifier particles (B) and mixed therewith in advance thereby to improve the fluidity and dispersibility thereof, and then the resultant modifier particles (B) are uniformly attached to the base particles (A).

In such embodiment, a Henschel mixer as shown in FIG. 1 may preferably used as the mixing device. Further, the following mixing conditions may preferably be used.

rotating speed of the stirring vane: 1,000–4,000 rpm,
mixing time: 1–30 min,
temperature: 10°–30° C.,
humidity: 15–90% RH.

In this embodiment, there may preferably be used positive chargeability-imparted silica, when positively chargeable modifier particles (B) are used. On the other hand, there may preferably be used negative chargeability-imparted silica, when negatively chargeable modifier particles (B) are used.

The silica powder may preferably be added to the modifier particles (B) in an amount of 0.01–10 wt. %, more preferably 0.1–5 wt. %, based on the weight of the modifier particles (B). As such treated silica, there may preferably be used hydrophobic silica fine powder which has been treated with one or more species of a positive or negative chargeability-imparting silane coupling agent, or a silane oil.

The fine silica powder used in this embodiment may preferably have a specific surface area measured by the nitrogen adsorption method of 40–400 $m^2/g$. Further, the fine silica powder should preferably exhibit a hydrophobicity of 30–80 as measured by the methanol titration test in view of environmental stability of the resultant toner.

The "methanol titration test" defined in the present specification for the evaluation of hydrophobicity of treated fine silica powder is conducted as follows.

Sample fine silica powder (0.2 g) are charged into 50 ml of water in 250 ml-Erlenmeyer's flask. Methanol is added dropwise from a buret until the whole amount of the silica is wetted therewith. During this operation, the content in the flask is constantly stirred by means of a magnetic stirrer. The end point can be observed when the total amount of the fine silica particles is suspended in the liquid, and the hydrophobicity is represented by the percentage of the methanol in the liquid mixture of water and methanol on reaching the end point.

Then, a method of fixing will be described.

In a toner, it is not preferred that the fragment of the base particles (A) or the modifier particles (B) are freed, or that the modifier particles (B) once attached to the base particles (A) are again freed therefrom. Therefore, it is preferred that the modifier particles (B) are surely fixed to the base particles (A). Further, in this step, it is important to control the impact force so that the base particles (A) are not substantially pulverized, and to control the temperature so that fusion or agglomeration thereof does not occur.

Figure 2A:
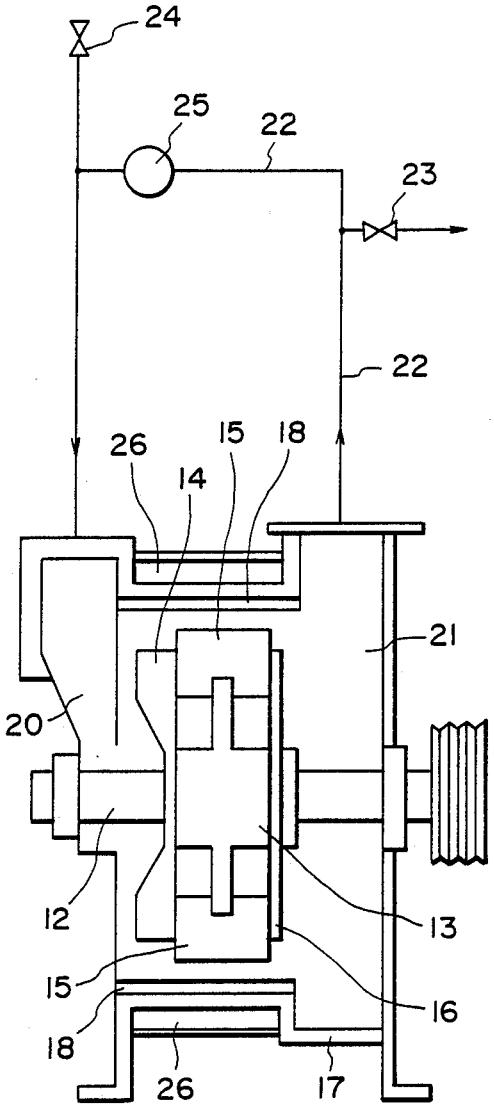
FIG. 2A is a schematic sectional view showing an embodiment of a device for fixing the modifier particles (B) to the base particles (A)
Figure 3A:
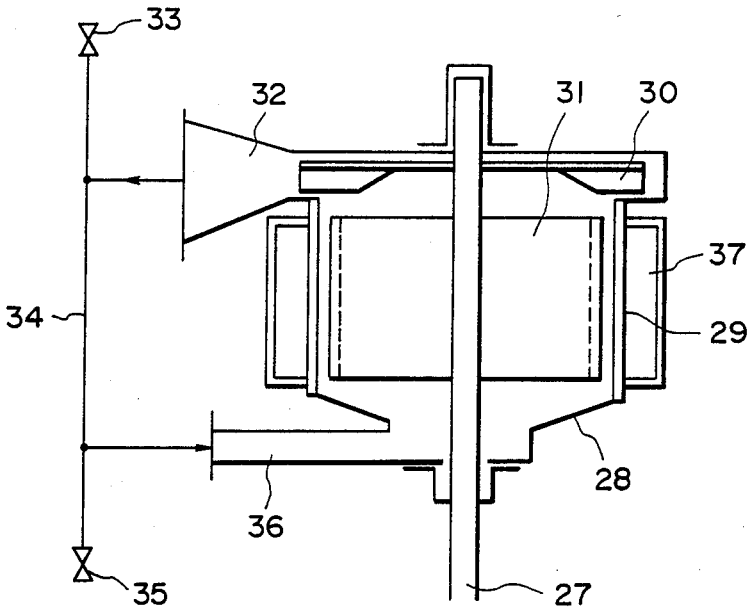
FIG. 3A is a schematic sectional view showing another embodiment of a device for fixing the modifier particles (B) to the base particles (A)
Figure 4A:
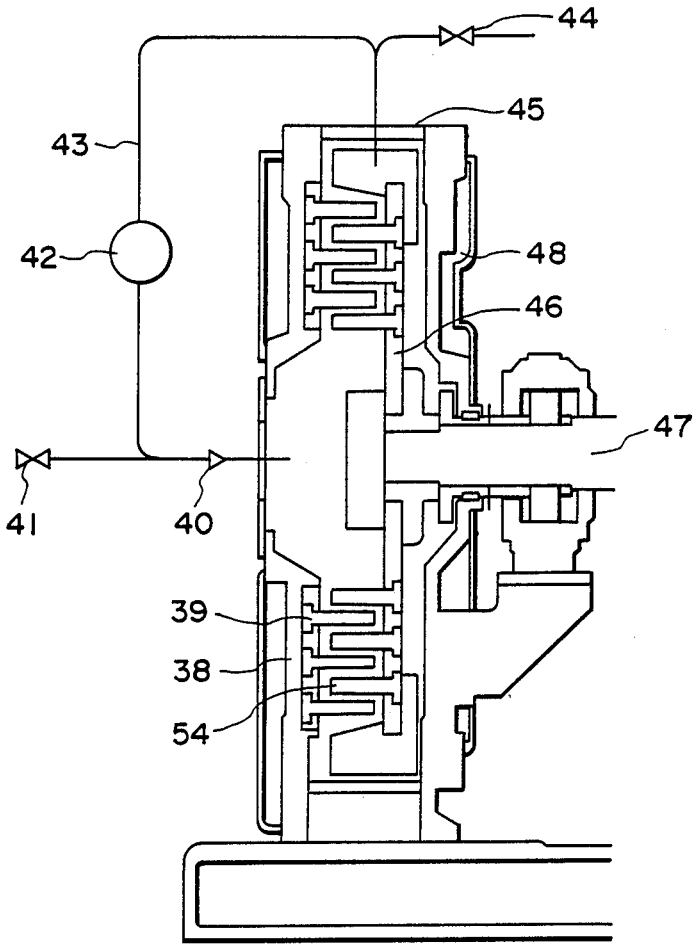
FIG. 4A is a schematic sectional view showing an embodiment of a pin mill-type device for fixing the modifier particles (B) to the base particles (A)

For example, there may effectively be used: a pin mill as shown in FIG. 4A which has a recycling function and has a large number of rotating pins; or a pulverizer as shown in FIG. 2A or 3A which has a recycling mechanism and wherein an impact force is provided between a liner (fixed member) and a rotating blade or hammer (rotating member).

The fixing step may preferably be conducted at a peripheral speed of 30–150 m/sec, more preferably 30–130 m/sec, at the tip of the blade or hammer. The temperature in the fixing step may preferably be 20° C.–100° C., more preferably 20° C.–90° C., further preferably 30° C.–70° C. while it varies depending on the physical property of the base particles (A) and the modifier particles (B). Further, the temperature in a treatment chamber (gaseous phase) may preferably be at least 20° C. lower than the softening point of the base particles (A). Further, the total residence time of the base particles and the modifier particles in an impact zone (i.e., the portion in which the impact force is applied thereto) may preferably be 0.2–12 sec. The particles may be recycled so as to pass through the impact zone plural times.

In a case where the pin mill is used, it is generally required to increase the powder density. However, in the type of a machine as shown in FIG. 2A or 3A, more latitude in the density may be allowed because the powder to be treated is gathered into the vicinity of the liner under the action of a centrifugal force.

Figure 2B:
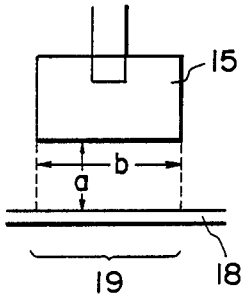
FIG. 2B is an enlarged schematic sectional view showing a part of the device shown in FIG. 2A.

The device shown in FIGS. 2A and 2B comprises a rotation axis 12, a rotor 13, a dispersing vane 14, a rotating member (blade) 15, a partition circular plate 16, a casing 17, a liner (fixed member) 18, an impact zone 19 (FIG. 2B), an inlet chamber 20, an outlet chamber 21, a return conduit 22, an outlet valve 23 for a product, an intake valve 24 for a feed material, a blower 25, and a jacket 26.

The minimum clearance between the pins of the pin mill or the clearance between the liner and the blade or hammer may preferably be about 0.5–5 mm, more preferably 1–3 mm in order to obtain more desirable results of fixing.

Figure 8:
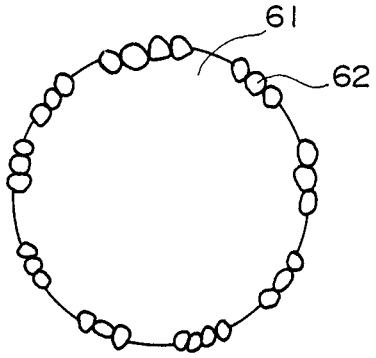
FIG. 8 is a schematic sectional view showing a toner obtained in the present invention wherein modifier particles (B1) comprising a colorant are fixed to the base particles.
Figure 9:
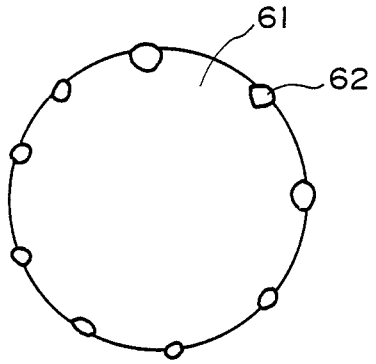
FIG. 9 is a schematic sectional view showing a toner obtained in the present invention wherein modifier particles (B2) comprising a charge controller are fixed to the base particles.

More specifically, referring to FIG. 2A, the base particles (A) and the modifier particles (B) pretreated in the above-mentioned manner are supplied through the inlet 24, passed through the inlet chamber 20, and then passed through the impact zone 19 between the liner 18 and the blade 15 which rotates along the rotating dispersing vane 14. Thereafter, these particles are passed through the outlet chamber 21, the return conduit 22 and the blower 25, and again recycled in such circuit. After the completion of the fixing treatment, the base particles 61 comprising the modifier particles 62 and having a form as shown in FIG. 8 or FIG. 9 are discharged through the outlet 23 for a product.

In this treatment, the powder comprising the base particles (A) and the modifier particles (B) are supplied with an impact force in the impact zone 19 surrounded by the blade 15 and the liner 18, whereby the modifier particles (B) are fixed to the base particles (A). It is preferred to control the temperature by supplying cooling water to the jacket 26.

In FIG. 2B, the clearance a between the rotating member (blade) 15 and the liner 18 is a minimum clearance, and the space corresponding to the width b of the rotating blade 15 is the impact zone. The width b may preferably be 10–1,000 mm. Further, the distance from the tip of a blade 15 on one side to that of the blade 15 on the opposite side (i.e., the distance from the tip of the upper blade 15 to that of the lower blade 15, as shown in FIG. 2A) may preferably be 100–1,000 mm in view of fixing efficiency.

Figure 3B:
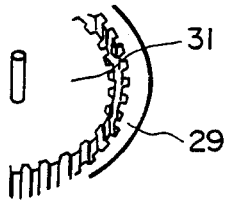
FIGS. 3B and 3C are enlarged schematic views each showing a part of the device shown in FIG. 3A.
Figure 3C:
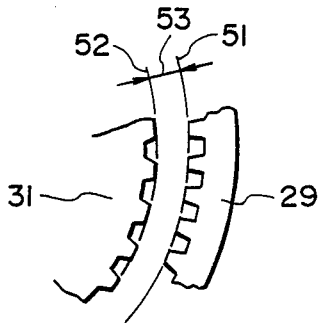

On the other hand, a device for fixing treatment as shown in FIGS. 3A, 3B and 3C comprises a rotation axis 27, a casing 28, a liner 29, a blower vane 30, a rotor 31 having a blade, an outlet port 32, a feed material supply port 33, a return conduit 34, an outlet 35 for a product, an inlet port 36, and a jacket 37.

FIG. 3C shows a positional relationship between the liner 29 and the rotating rotor 31 in the fixing device shown in FIG. 3A. The minimum clearance 53 between the liner 29 and the rotor 31 is the difference in radius between two kinds of circles, i.e., a circle 51 obtained by connecting the tip points of the protrusions of the liner 29 protruding toward the inside of the device; and a circle 52 traced by the point on the periphery of the protrusion of the rotor 31. This minimum clearance 53 may be determined in the same manner as described above, in a case where a blade or a hammer is used instead of the rotor 31.

Figure 4B:
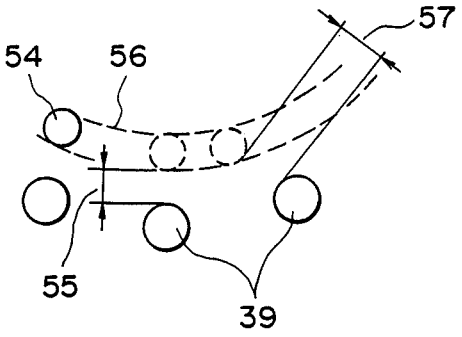
FIG. 4B is an enlarged schematic sectional view showing a part of the device shown in FIG. 4A.

Further, a pin mill-type device for fixing treatment as shown in FIGS. 4A and 4B comprises a casing 38, a fixed pin 39, an inlet port 40, a feed material supply port 41, a recycling blower 42, a return conduit 43, an outlet 44 for a product, an outlet port 45, a rotor 46, a rotation axis 47, a jacket 48, and a rotating pin 54.

FIG. 4B shows a schematic view of the pins in the pin mill-type fixing device as viewed from the front direction of the device. In FIG. 4B, the clearance 55 between the fixed pin 39 and the rotating pin 54 is a minimum clearance. Incidentally, reference numeral 57 denotes a maximum clearance between the fixed pin 39 and the rotating pin 54, and numeral 56 denotes a circle traced by the rotating pin 54. In case of the pin mill, a preferred result may be obtained by adjusting the minimum clearance between the pins to 0.5–5 mm and adjusting the maximum clearance to 10 mm or below, more preferably 5 mm or below.

In the above-mentioned FIGS. 2B, 3C and 4B, an impact force is applied to a mixture of the base particles and the modifier particles between a moving member (such as a rotating member) and a fixed member. In the present invention, such impact force may also be applied to the mixture between at least two moving members such as rotating members.

Incidentally, when the modifier particles (B) are uniformly attached to the base particles (A), the base particles (A) may preferably be those having little protrusion in view of the uniform attachment of the modifier particles (B).

Further, in the present invention, the base particles (A) may preferably have a volume-average particle size of 2–20 microns.

In the toner obtained in the present invention, the modifier particles (B) are surely fixed to the base particles (A), e.g., through embedding in the base particles. Accordingly, even when the toner in the present invention is subjected to ultrasonic dispersion under the same conditions as described in the case of the measurement of a particle size distribution, the modifier particles (B) are not substantially removed from the base particles (A).

The toner obtained by the process according to the present invention is applicable to the known dry system methods for developing electrostatic images including the two-component developing methods such a the cascade method, the magnetic brush method, the microtoning method and the two-component AC bias developing method; the one-component developing methods using a magnetic toner such as the insulating one-component developing method and the jumping developing method; the powder cloud method and the fur brush method; the nonmagnetic one-component developing method wherein the toner is carried on a toner-carrying member to be conveyed to a developing position and subjected to development thereat; and the electric field curtain method wherein the toner is conveyed by an electric field curtain to a developing position and subjected to development thereat.

In a case where a toner for a two-component developer is produced in the present invention, the carrier usable may be composed of, a metal such as iron, nickel, copper, zinc, cobalt, manganese, chromium, and rare earth elements, or of an alloy of these, in the surface-oxidized form or in the surface-non-oxidized form, or of an oxide or ferrite form of these metal or alloys. The production process of the carrier is not particularly limited. The surfaces of the carrier may be coated with a resin.

The coating material on the carrier surface may vary depending on the toner material and may, for example, be polytetrafluoroethylene, monochlorotrifluoroethylene polymer, polyvinylidene fluoride, silicone resin, polyester resin, metal complex of di-tertiarybutylsalicylic acid, styrene-type resin, acrylic resin, polyamide, polyvinylbutyral, nigrosine, aminoacrylate resin, and basic dye or its lake. These coating materials may be used singly or in combination.

The coating amount of the above coating material may be determined appropriately, but may generally be in a proportion of 0.1 to 30 wt. %, preferably 0.5–20 wt. %, in total, based on the carrier.

The carrier may have an average particle size of 20–100 microns, preferably 25–70 microns, more preferably 30–65 microns.

The carrier, in its particularly preferred form, may be composed of ferrite particles coated with a silicone resin or ternary ferrite particles of Cu-Zn-Fe. Further, there may particularly preferably be used such ternary ferrite particles coated with a resin composition, such as that of a fluorine-containing resin and a styrene-type resin. Examples of the combination constituting the resin composition include polyvinylidene fluoride and styrene-methyl methacrylate resin; polytetrafluorooctylene and styrene-methyl methacrylate resin; and a fluorine-containing copolymer and a styrene-type copolymer. The proportions of the fluorine-containing resin and the styrene-type resin may be 90:10 to 20:80, preferably 70:30 to 30:70. It is preferred to coat the ferrite particles with 0.01 to 5 wt. %, particularly 0.1 to 1 wt. %, of the resin composition. The carrier may preferably have a particle size distribution such that particles in the range of 250 mesh-pass and 350 mesh-on occupy 70 wt. % or more. A further preferred example of the fluorine-containing resin includes vinylidene fluoride-tetrafluoroethylene copolymer (10:90 to 90:10), and examples of the styrene-type copolymer include styrene-2-ethylhexyl acrylate copolymer (20:80 to 80:20) and styrene-2-ethylhexyl acrylate-methyl methacrylate copolymer (20 to 60:5 to 30:10 to 50).

The coated ferrite carrier satisfying the above conditions has a sharp particle size distribution, provides a preferable triboelectric charge characteristics to a color toner kit in the present invention, and provides a developer with improved electrophotographic characteristics.

A two-component developer may be prepared by mixing a toner according to the present invention with a carrier so as to give a toner concentration in the developer of 5.0 wt. %–15 wt. %, preferably 6 wt. % to 13 wt. %, which generally provides good results. A toner concentration of below 5.0% results in a low image density of the obtained toner image, and a toner concentration of above 15% is liable to result in increased fog and scattering of toner in the apparatus and a decrease in life of the developer.

In the present invention, a fluidity improver may be added to the toner comprising colorant-containing resin particles to improve the fluidity or flowability of the toner.

Examples of the fluidity improver may include powder of fluorine-containing resins (polyvinylidene fluoride powder, polytetrafluoroethylene powder, etc.), aliphatic acid metal salts (zinc stearate, calcium stearate, lead stearate, etc.), metal salts (zinc oxide powder), fine powder silica (wet-process silica, dry process silica, surface-treated product of such silica with a silane coupling agent, a titanate coupling agent or a silicone oil, etc.).

The fluidity-improver may be added to the toner in a proportion of 0.1 to 3 wt. parts, per 100 wt. parts of the toner.

A preferred class of fluidity improver may be fine silica powder obtained by vapor phase oxidation of silicon halide, called dry-process silica or fumed silica. Such fine silica powder may, for example, be obtained by pyrolytic oxidation of gaseous silicon tetrachloride in oxygen-hydrogen flame. The basic reaction scheme may be represented as follows;

$$SiCl_4+2H_2+O_2 \rightarrow SiO_2+4HCl$$

In the above preparation step, it is also possible to obtain complex fine powder of silica and other metal oxides by using other metal halides such as aluminum chloride or titanium chloride together with silicon halides.

It is preferred to use silica fine powder, of which mean primary particle size is desirably within the range of from 0.001 to 2 micron, particularly preferably of from 0.002 to 0.2 micron.

Further, another additive generally used in the electrophotography such as an abrasive, (particles comprising $CeO_2$, etc.) may be used in combination with the above-mentioned fluidity improver.

The present invention is described in detail below by referring to Examples, by which the present invention is not limited at all. In the following formulations, parts are parts by weight, unless otherwise noted specifically.

EXAMPLE 1

| | |
|---|---|
| Styrene monomer | 170 wt. parts |
| 2-Ethylhexyl acrylate monomer | 30 wt. parts |
| Styrene-dimethylaminoethylmethacrylate copolymer (dimethylaminoethyl methacrylate: 10 mol %, wt. average molecular weight Mw = 40,000) | 8 wt. parts |
| NK-Ester 2G (vinyl-type crosslinking agent, mfd. by Shin-Nakamura Kagaku Kogyo K.K.) | 1.1 wt. parts |
| Carbon black (STERING R, mfd. by Cabot Co., U.S.A.) | 20 wt. parts |

The above ingredients were mixed at 60° C. for 4 hours by means of an attritor to prepare a monomer composition. To the thus prepared monomer composition, 10 wt. parts of 2,2'-azobis-(2,4-dimethylvaleronitrile) and 1 wt. part of 2,2'-azobisisobutyronitrile as polymerization initiator were added and mixed therewith.

The thus obtained monomer composition was charged in an aqueous medium which comprised 1200 wt. parts of ion-exchange water containing 10 wt. parts of silica (Aerosil #200, mfd. by Nihon Aerosil K.K.) and was heated to 60° C., under stirring by means of a TK-homomixer (mfd. by Tokushu Kika Kogyo K.K.) and stirred at 10,000 rpm for 25 min. to form particles through dispersion. Further, the stirrer was replaced by a paddle blade stirrer and stirring was conducted at 60° C. for 10 hours to complete the polymerization.

The aqueous medium containing the thus obtained polymer particles wa cooled; and the particles were washed with a sodium hydroxide solution to remove the silica through dissolution thereof, washed with water, dehydrated and dried, and classified thereby to obtain colored base particles (A2) having a volume-average particle size of 11 microns and a softening point of 115° C.

Separately, modifier particles (B2) having a charge-controlling property were prepared in the following manner.

| | |
|---|---|
| Polystyrene (glass transition temp. Tg = 90° C., number-average molecular weight Mw = 20,000) | 100 wt. parts |
| Nigrosine (mfd.) by Orient Kagaku K.K.) | 4 wt. parts |

A mixture having the above prescription was kneaded at 120° C. for 20 min. by means of a roll mill, cooled, and then coarsely pulverized by means of a pulverizer (Hammer Mill Model H-8, mfd. by Hosokawa Micron K.K.) Then, the pulverized product was further micro-pulverized by means of a pulverizer equipped with a classifier for classifying coarse powder (Jet Mill I2-DS2, mfd. by Nippon Pneumatic Kogyo K.K.), and classified by means of a wind-force classifier thereby to obtain modifier particles (B2) having a volume-average particle size of 1 micron.

Then, 100 wt. parts of the thus obtained modifier particles (B2) were mixed with 2 wt. parts of silica fine powder (BET specific surface area = 130 $m^2/g$) treated with 10 wt. % (based on the treated product) of an amino-silicone oil for 5 min by means of a Henschel mixer at 3,500 rpm. 50 wt. parts of the resultant mixture comprising the above-mentioned modifier particles (B2) and the silica fine powder were dispersed in 1000 wt. parts of the above-prepared base particles (A2) by means of a device having a 50 cm-length stirring vane (Henschel Mixer FM 75C, mfd. by Mitsui-Miike Seisakusho K.K.) shown in FIG. 1 at a peripheral speed of the stirring vane of 30 m/sec for 2 min., thereby to effect a pretreatment.

Thereafter, the resultant mixture was further treated by means of a device shown in FIG. 2A (width b of the blade: 15 mm, distance from the tip of the upper blade 15 to that of the lower blade 15: 200 mm) at a peripheral speed of the blade of 60 m/sec for a treatment time of 3 min., thereby to fix the modifier particles (B2) to the surfaces of the base particles (A2). In this treatment, the above-mentioned peripheral speed and the treatment time corresponded to the residence time in the impact zone of 2 sec, and the temperature in the interior of the device was 50° C. As a result, a toner comprising modified particles having a coverage of 13.7% was obtained.

According to an observation through an electron microscope (scanning-type), it was found that the modifier particles were fixed to partial surfaces of the base particles. The triboelectric charge of the toner was +15 μc/g.

0.5 wt. part of colloidal silica treated with 10 wt. % (based on the treated product) of an amino-silicone oil was externally added to 100 wt. parts of the toner prepared above, and thereafter the resultant mixture was mixed with 1000 wt. parts of 250–300 mesh ferrite particles (carrier) coated with a silicone resin thereby to prepare a developer.

The thus obtained developer was subjected to image formation by means of a copying machine (NP-3525, mfd. by Canon K.K.). As a result, in a successive copying test of 30,000 sheets, good images having an image density of about 1.3 without fog and image flow were obtained.

EXAMPLE 2

| | |
|---|---|
| Styrene monomer | 170 wt. parts |
| 2-Ethylhexyl acrylate monomer | 29 wt. parts |
| Cyclized rubber (Albex CK450, mfd. by Hoechst Japan, K.K.) | 10 wt. parts |
| NK-Ester 3G (mfd. by Shin-Nakamura Kagaku Kogyo K.K.) | 2 wt. parts |
| Carbon black (STERING R, mfd. by Cabot Co., U.S.A.) | 10 wt. parts |

The above ingredients were mixed at 60° C. for 4 hours by means of an attritor to prepare a monomer composition. To the thus prepared monomer composition, 10 wt. parts of 2,2'-azobis-(2,4-dimethylvaleronitrile) and 1 wt. part of 2,2'-azobisisobutyronitrile were added and mixed therewith.

The thus obtained monomer composition was charged in an aqueous medium comprising 1200 wt. parts of ion-exchange water containing 10 wt. parts of amino-modified silica (obtained by treating 100 wt. parts of Aerosil #200 with 5 wt. parts of aminopropyltriethoxysilane) and 15 wt. parts of 0.1 N-hydrochloric acid and heated to 60° C., under stirring by means of a TK-homomixer, and stirred at 10,000 rpm for 15 min. to form particles through dispersion. Further, the stirrer was replaced by a paddle blade stirrer and stirring was conducted at 60° C. for 10 hours to complete the polymerization.

The aqueous medium containing the thus obtained polymer particles was cooled; and the particles were washed with a sodium hydroxide solution to remove the amino-modified silica through dissolution thereof, washed with water, dehydrated and dried, and classified thereby to obtain base particles (A2) having a volume-average particle size of 11 microns and a softening point of 120° C.

Separately, modifier particles (B2) were prepared in the following manner.

| | |
|---|---|
| Styrene monomer | 90 wt. parts |
| Cyclixed rubber (Albex CK450, mfd. by Hoechst Japan, K.K.) | 10 wt. parts |
| Cr complex of di-tertiary-butyl-salicylic acid | 4 wt. parts |

The above ingredients were mixed at 130° C. for 5 min., cooled under stirring, and kept at 60° C. To the resultant mixture, 3 wt. parts of 2,2'-azobis(2,4-dimethylvaleronitrile) were added thereby to prepare a monomer composition.

The thus obtained monomer composition was charged in a 21-stainless steel vessel which already contained 12 wt. parts of amino-modified silica (attained by treating 100 wt. parts of Aerosoil #200 (mfd. by Nihon Aerosil K.K.) with 5 wt. parts of aminopropyltriethoxysilane), 600 wt. parts of distilled water and 30 wt. parts of 1/10 N-hydrochloric acid, and the mixture was stirred at 60° C. for 60 min. by means of a TK-homomixer (mfd. by Tokushu Kika Kogyo K.K.) rotating at 10,000 rpm for preliminary dispersion, to prepare a liquid dispersion. The dispersion was then subjected to granulation by means of a pistontype high pressure homogenizer (Model 15M-8TA, by Gaulin Corp.) at an ejection pressure of 400 kg/cm$^2$ for 5 min. The dispersion was then subjected to stirring by means of a paddle blade stirrer for 10 hours at 60° C. to complete the polymerization.

Thereafter, the resultant dispersion was subjected to cooling, washing with an aqueous sodium hydroxide solution, dehydration and drying to obtain modifier particles (B2) having a Tg of 90° C. and a volume-average particle size of 1.2 micron.

50 wt. parts of the thus prepared modifier particles (B2) were dispersed in 1000 wt. parts of the above-prepared base particles (A2) by mean of the device shown in FIG. 1 at a peripheral speed of the stirring vane of 30 m/sec for 5 min., thereby to effect a pretreatment.

Thereafter, the resultant mixture was further treated by means of the device shown in FIG. 2A at a peripheral speed of the blade of 60 m/sec for 3 min., thereby to fix the modifier particles (B2) to the surfaces of the base particles (A2). In this treatment, the residence time of the particles in the impact zone was 2 sec, and the temperature in the interior of the device was 50° C. As a result, a toner comprising modified particles having a coverage of 11.5% was obtained.

According to an observation through an electron microscope, it was found that the modifier particles were fixed to partial surfaces of the base particles. The triboelectric charge of the toner was −12 μc/g.

0.5 wt. part of colloidal silica (R-972, mfd. by Nihon Aerosil K.K.) was externally added to 100 wt. parts of the toner prepared above.

Separately, 100 wt. parts of 250–300 mesh ferrite particles were coated with 0.8 wt. part of a silicone resin thereby to prepare magnetic particles (carrier). Then, 10 wt. parts of the above toner were mixed with 100 wt. parts of the thus prepared magnetic particles thereby to prepare a developer.

Figure 5:
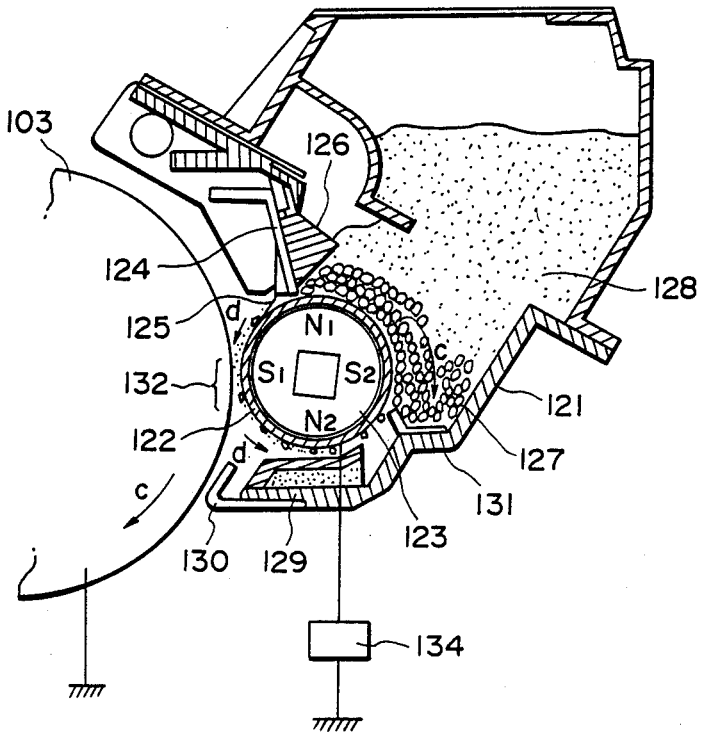
FIG. 5 is a schematic sectional view showing an image-forming device for effecting image formation by using a toner obtained in the present invention.

The thus prepared developer was charged into a developing device as shown in FIG. 5 and subjected to development, whereby a good image having an image density of 1.3 was obtained.

Figure 6:
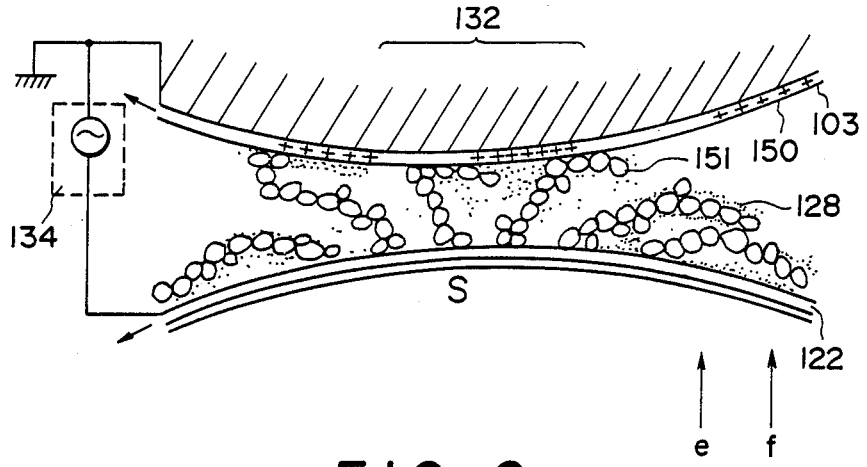
FIGS. 6 and 7 are enlarged schematic sectional views each showing a developing zone in the image-forming device shown in FIG. 5.
Figure 7:
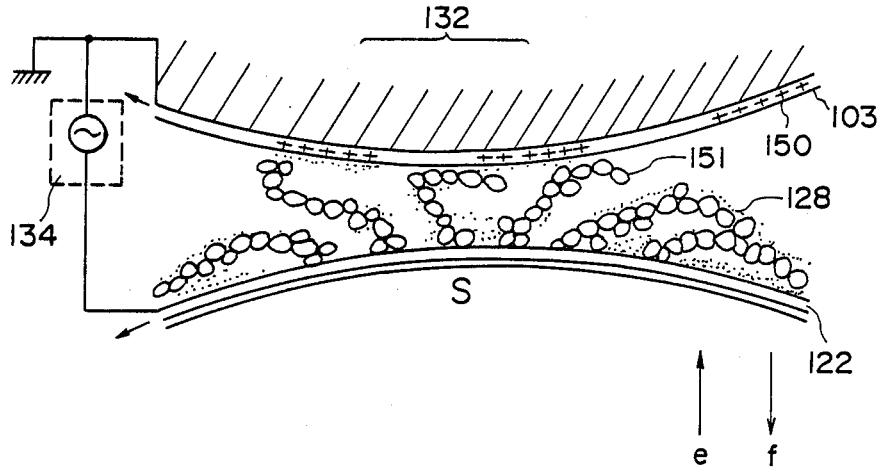

Incidentally, the developing apparatus shown in FIG. 5 comprises a photosensitive drum 103, a developer container 121, a non-magnetic sleeve 122, a fixed magnet 123, a nonmagnetic blade 124, a member 126 for limiting a circulation region for magnetic particles, a container portion 129 for collecting a developer, a member 130 for preventing a scattering, a magnetic member 131 and a bias power supply 134. In FIG. 5, a reference numeral 127 denotes magnetic particles (carrier), numeral 128 denotes a nonmagnetic toner, and numeral 132 denotes a developing zone. Further, FIG. 6 and FIG. 7 are enlarged views of the developing zone of the apparatus shown in FIG. 5. In FIGS. 6 and 7, an arrow e denotes the direction of the electric field based on a DC bias component, and an arrow f denotes that based on an AC bais component.

Referring to FIG. 5, in this instance, the photosensitive drum 103 rotated in the direction of an arrow c at a peripheral speed of 60 mm/sec, and the sleeve 122 comprised a hollow cylinder of stainless steel (SUS 304) having an outside diameter of 32 mm and a thickness of 0.8 mm, and rotated in the direction of an arrow d at a peripheral speed of 66 mm/sec. The surface of the sleeve had been subjected to a irregular-shape sandblasting by using an Alundum abrasive (#600).

On the other hand, the fixed magnet 123 of a ferrite-sinter type having poles of $N_1$, $N_2$, $S_1$ and $S_2$ was disposed in the rotating sleeve 122. Thus, a maximum magnetic flux density of about 800 Gauss was exerted to the surface of the sleeve (developer-carrying member). The nonmagnetic blade 124 comprised nonmagnetic stainless steel and had a thickness of 1.2 mm. The blade 124 and the sleeve 122 were disposed at a gap of 400 microns. The sleeve 122 and the photosensitive drum 103 were disposed opposite to each other at a gap of 300 microns.

On the surface of the photosensitive drum 103, an electrostatic latent image 150 of a charge pattern comprising a dark portion of +600 V and a bright portion of +150 V was formed. A bias voltage having a frequency of 800 Hz, a peak-to-peak value of 1.4 KV and a central value of +300 V was applied to the sleeve 122 by means of the power supply 134. Thus, as shown in FIGS. 6 and 7, the electrostatic image formed on the photosensitive drum 103 was developed by using a magnetic brush 151.

As a result, even in a successive copying test of 5,000 sheets, good images having an image density of about 1.3 without a decrease in image density were obtained.

EXAMPLE 3

| | |
|---|---|
| Styrene monomer | 180 wt. parts |
| 2-Ethylhexyl acrylate | 20 wt. parts |
| NK-Ester 2G (mfd. by Shin-Nakamura Kagaku Kogyo K.K.) | 1.1 wt. parts |
| Paraffin 155° F. (mfd. by Nihon Seiro K.K.) | 8 wt. parts |
| Carbon black (STERING R, mfd. by Cabot Co., U.S.A.) | 20 wt. parts |

The above ingredients were mixed at 60° C. for 4 hours by means of an attritor to prepare a monomer composition. To the thus prepared monomer composition, 10 wt. parts of 2,2'-azobis-(2,4-dimethylvaleronitrile) and 1 wt. part of 2,2'-azobisisobutyronitrile were added and mixed therewith.

The thus obtained monomer composition was charged in an aqueous medium comprising 1200 wt. parts of ion-exchange water containing 20 wt. parts of calcium phosphate (obtained from sodium phosphate and calcium chloride) and heated to 60° C., under stirring by means of a TK-homomixer, and stirred at 10,000 rpm for 25 min to form particles through dispersion. Further, the stirrer was replaced by a paddle blade stirrer and stirring was conducted at 60° C. for 10 hours to complete the polymerization.

The aqueous medium containing the thus obtained polymer particles was cooled; and the particles were washed with a 1/10-N hydrochloric acid to remove the calcium phosphate silica through dissolution thereof, washed with water, dehydrated and dried, and classified thereby to obtain base particles (A2) having a volume-average particle size of 11.5 microns and a softening point of 125° C. in a yield of 70 wt. %.

Separately, modifier particles (B2) were prepared in the following manner.

| | |
|---|---|
| Polystyrene (glass transition temp. Tg = 90° C., weight-average molecular weight Mw = 40,000) | 100 wt. parts |
| Cr complex of di-tertiary-butylsalicylic acid | 4 wt. parts |

A mixture having the above prescription was kneaded at 120° C. by means of a roll mill, cooled, and then coarsely pulverized by means of a speed mill. Then, the pulverized product was further micropulverized by means of a jet mill, and classified by means of a wind-force classifier thereby to obtain modifier particles (B2) having a volume-average particle size of 1 micron which contained 5% or less of particles having a particle size of 2 microns or above.

Then, 60 wt. parts of the thus obtained modifier particles (B2) were dispersed in 1000 wt. parts of the above-prepared base particles (A2) by means of the device shown in FIG. 1 at a peripheral speed of the stirring vane of 30 m/sec for 5 min., thereby to effect a pretreatment.

Thereafter, the resultant mixture was further treated by means of the device shown in FIG. 2A at a minimum clearance of 1 mm, at a peripheral speed of the blade of 60 m/sec for 3 min., thereby to fix the modifier particles (B2) to the surfaces of the base particles (A2). In the treatment, the residence time of the particles in the impact zone was 2 sec., and the temperature in the interior of the device was 50° C. As a result, a toner comprising modified particles having a coverage of the base particles (A2) with the modifier particles (B2) of 17.3% was obtained.

According to an observation through an electron microscope, it was found that the modifier particles were fixed to partial surfaces of the base particles. The triboelectric charge of the toner was −13 μc/g.

0.5 wt. part of colloidal silica (R-972, mfd. by Nihon Aerosil K.K.) was externally added to 100 wt. parts of the toner prepared above.

Separately, 100 wt. parts of 250–300 mesh ferrite particles were coated with 0.8 wt. part of a silicone resin thereby to prepare magnetic particles (carrier). Then, 10 wt. parts of the above toner were mixed with 100 wt. parts of the thus prepared magnetic particles thereby to prepare a developer.

The thus prepared developer wa charged into a developing device as shown in FIG. 5 and subjected to development, whereby good images were obtained. Further, in a successive copying test of 5,000 sheets, good images were also obtained.

EXAMPLE 4

| | |
|---|---|
| Styrene monomer | 170 wt. parts |
| 2-Ethylhexyl acrylate monomer | 30 wt. parts |
| Styrene-dimethylaminoethyl-methacrylate copolymer (dimethylaminoethyl methacrylate; 10 mol %, number-average molecular weight Mn = 20,000) | 8 wt. parts |
| NK-Ester 2G (mfd. by Shin-Nakamura Kagaku Kogyo K.K.) | 1.1 wt. part |
| Carbon black | 20 wt. parts |

-continued

| |
|---|
| (STERING R, mfd. by Cabot Co., U.S.A.) |

The above ingredients were mixed at 60° C. for 4 hours by means of an attritor to prepare a monomer composition. To the thus prepared monomer composition, 10 wt. parts of 2,2'-azobis-(2,4-dimethylvaleronitrile) and 1 wt. part of 2,2'-azobisisobutylonitrile were added and mixed therewith.

The thus obtained monomer composition was charged in an aqueous medium which comprised 1200 wt. parts of ion-exchange water containing 10 wt. parts of silica (Aerosil #200, mfd. by Nihon Aerosil K.K.) and was heated to 60° C., under stirring by means of a TK-homomixer and stirred at 10,000 rpm for 25 min. to form particles through dispersion. Further, the stirrer was replaced by a paddle blade stirrer and stirring was conducted at 60° C. for 10 hours to complete the polymerization.

The aqueous medium containing the thus obtained polymer particles was cooled; and the particles were washed with a sodium hydroxide solution to remove the silica through dissolution, washed with water, dehydrated and dried, and classified thereby to obtain base particles (A2) having a volume-average particle size of 11 microns and a softening point of 115° C.

Separately, modifier particles (B2) were prepared in the following manner.

| | |
|---|---|
| Polystyrene (glass transition temp. Tg = 90° C., weight-average molecular weight Mw = 40,000) | 100 wt. parts |
| Nigrosine (mfd. by Orient Kagaku K.K.) | 4 wt. parts |

A mixture having the above prescription was kneaded at 120° C. by means of a roll mill, cooled and then coarsely pulverized by means of a speed mill. Then, the pulverized product was further micropulverized by means of a jet mill, and classified by means of a wind-force classifier thereby to obtain modifier particles (B2) having a volume-average particle size of 1 micron.

Then, 50 wt. parts of the thus obtained modifier particles (B2) were dispersed in 1000 wt. parts of the above-prepared base particles (A2) by means of the device shown in FIG. 1 at a peripheral speed of the stirring vane of 30 m/sec for 5 min., thereby to effect a pretreatment.

Thereafter, the resultant mixture was further treated by means of the device shown in FIG. 2A at a minimum clearance of 1 mm at a peripheral speed of the blade of 60 m/sec for 3 min., thereby to fix the modifier particles (B2) to the surfaces of the base particles (A2). In this treatment, the residence time in the impact zone was 2 sec., and the temperature in the interior of the device wa 50° C. As a result, a toner comprising modified particles having a coverage of 13.8% was obtained.

According to an observation through an electron microscope, it was found that the modifier particles were fixed to partial surfaces of the base particles. The triboelectric charge of the toner was +15 μc/g.

0.5 wt. part of colloidal silica treated with an aminosilicone oil was externally added to 100 wt. parts of the toner prepared above.

The thus obtained toner was subjected to image formation by means of a copying machine (NP-3525, mfd. by Canon K.K.). As a result, even in a successive copying test of 5,000 sheets, good images without image flow were obtained.

EXAMPLE 5

| | |
|---|---|
| Styrene-butyl acrylate-divinylbenzene copolymer (weight ratio 80:20:1, weight-average molecular weight Mw: about 300,000) | 100 wt. parts |
| Polyethylene wax (Hi-Wax 200P, mfd. by Mitsui Sekiyu Kagaku) | 4 wt. parts |
| Magnetic powder (BET specific surface area: 8 $m^2/g$, oil absorption: 29 ml/100 g) | 6 wt. parts |

A mixture having the above prescription was melt-kneaded at 150° C. for about 30 min. by means of a roll mill. The obtained kneaded product was cooled and then pulverized by means of a pulverizer (Jet Mill I2-DS2, mfd. by Nippon Pneumatic Kogyo K.K.) into particles having a volume-average particle size of about 10 microns. Fine powder was removed from the pulverized product by means of a zigzag classifier (mfd. by Alpine Co.) thereby to obtain base particles (A2) having a volume-average particle size of about 12 microns and a softening point of 125° C.

Then, 40 wt. parts of the above-mentioned modifier particles (B2) used in Example 4 were dispersed in 1000 wt. parts of the above-prepared base particles (A2) by means of the device shown in FIG. 1 at a peripheral speed of the stirring vane of 30 m/sec for 5 min., thereby to effect a pretreatment.

Thereafter, the resultant mixture was further treated by means of the device shown in FIG. 2A at a minimum clearance of 1 mm, at a peripheral speed of the blade of 60 m/sec for 5 min., thereby to fix the modifier particles (B2) to the surfaces of the base particles (A2). In this treatment, the residence time in the impact zone was 3.45 sec., and the temperature in the interior of the device was 55° C. As a result, a toner comprising modified particles having a coverage of 16.2% was obtained.

According to an observation through an electron microscope, it was found that the modifier particles were fixed to partial surfaces of the base particles. The triboelectric charge of the toner was +14 μc/g.

0.5 wt. part of colloidal silica treated with an aminosilicone oil was externally added to 100 wt. parts of the toner prepared above.

The thus obtained toner was subjected to image formation by means of a copying machine (NP-3525, mfd. by Canon K.K.). As a result, even in a successive copying test of 5,000 sheets, good images without fog and image flow were obtained.

EXAMPLE 6

5 wt. parts of a Cr Complex of di-tertiarybutylsalicylic acid (average particle size: 1 micron, density: 1.1) were dispersed in 1000 wt. parts of the base particles (A2) prepared in Example 2 by means of the device shown in FIG. 1 at a peripheral speed of the stirring vane of 30 m/sec for 10 min., thereby to effect a pretreatment.

Thereafter, the resultant mixture was further treated by means of the device shown in FIG. 2A at a minimum clearance of 1 mm, at a peripheral speed of the blade of 60 m/sec for 6 min., thereby to fix the modifier particles (B2) to the surfaces of the base particles (A2). In this treatment, the residence time in the impact zone was 4 sec., and the temperature in the interior of the device was 60° C. As a result, a toner comprising modified particles having a coverage of 1.3% was obtained.

The thus prepared toner was subjected to image formation in the same manner as in Example 2, whereby good images were obtained.

COMPARATIVE EXAMPLE 1

The base particles (A2) (triboelectric charge: −2 μC/g) prepared in Example 3 were as such used as a toner, and was subjected to image formation in the same manner as in Example 3. As a result, only images having a low image density of 0.2–0.4 with much fog were obtained at the time of 1,000 sheets of copying.

COMPARATIVE EXAMPLE 2

0.5 wt. part of colloidal silica treated with an aminosilicone oil was externally added to the base particles (A2) (triboelectric charge: −2 μc/g) prepared in Example 5 and the resultant mixture was subjected to image formation by means of a copying machine (NP-3525, mfd. by Canon K.K.). As a result, only images having a low image density of 0.2–0.4 with considerable fog were obtained at the time of 1,000 sheets of copying.

COMPARATIVE EXAMPLE 3

40 wt. parts of the modifier particles (B2) prepared in Example 4 were added to 1000 wt. parts of base particles (A2) prepared in Example 5, and the resultant mixture was kneaded, and pulverized in the same manner as in Example 5 thereby to obtain a toner having a volume-average particle size of 12 microns and a triboelectric charge of +2 μc/g.

The thus prepared toner was subjected to external addition and image formation in the same manner as in Example 5. As a result, only images having a low image density of 0.2–0.4 with considerable fog were obtained at the time of 1,000 sheets of copying.

EXAMPLE 7

| | |
|---|---|
| Styrene monomer | 170 wt. parts |
| 2-Ethylhexyl acrylate | 30 wt. parts |
| Cyclized rubber (Albex CK450, mfd. by Hoechst Japan, K.K.) | 15 wt. parts |
| Paraffin 155° C. (mfd. by Nihon Seiro K.K.) | 8 wt. parts |
| NK-Ester 2G (mfd. by Shin-Nakamura Kagaky Kogyo K.K.) | 1 wt. part |

The above ingredients were mixed at 60° C. for 4 hours by means of an attritor to prepare a monomer composition. To the thus prepared monomer composition, 10 wt. parts of 2,2'-azobis-(2,4-dimethylvaleronitrile) and 1 wt. part of 2,2'-azobisisobutyronitrile were added and mixed therewith.

The thus obtained monomer composition was charged in an aqueous medium comprising 1200 wt. parts of ion-exchange water containing 10 wt. parts of amino-modified silica (obtained by treating 100 wt. parts of Aerosil #200 with 5 wt. parts of aminopropyltriethoxysilane) and 15 wt. parts of 0.1 N-hydrochloric acid and heated to 60° C., under stirring by means of a TK-homomixer, and stirred at 10,000 rpm for 25 min. to form particles through dispersion. Further, the stirrer was replaced by a paddle blade stirrer and stirring was conducted at 60° C. for 10 hours to complete the polymerization.

The aqueous medium containing the thus obtained polymer particles was cooled; and the particles were washed with a sodium hydroxide solution to remove the amino-modified silica through dissolution, washed with water, dehydrated and dried, and classified thereby to obtain colorless base particles (A1) having a volume-average particle size of 9.0 microns.

Separately, modifier particles (B1) containing a colorant were prepared in the following manner.

| | |
|---|---|
| Polystyrene | 100 wt. parts |
| C.I. Pigment Yellow 17 | 20 wt. parts |
| Cr complex of di-tertiary-butyl salicylic acid | 4 wt. parts |

A mixture having the above prescription was kneaded at 120° C. by means of a roll mill for about 20 min., cooled, and then coarsely pulverized by means of a speed mill. Then, the pulverized product was further micro-pulverized by means of a jet mill, and classified by means of a wind-force classifier thereby to obtain modifier particles (B1) having a volume-average particle size of 1 micron which contained 5% or less of particles having a particle size of 2 microns or above.

Then, 300 wt. parts of the thus obtained modifier particles (B1) were dispersed in 1000 wt. parts of the above-prepared base particles (A1) by means of the device shown in FIG. 1 at a peripheral speed of the stirring vane of 30 m/sec for 5 min., thereby to effect a pretreatment.

Thereafter, the resultant mixture was further treated by means of the device shown in FIG. 2A at a peripheral speed of the blade of 60 m/sec for 3 min., thereby to fix the modifier particles (B1) to the surfaces of the base particles (A1) and to prepare a toner. In this treatment, the residence time in the impact zone of 1 sec.

According to an observation through an electron microscope, it was found that the modifier particles (B1) were fixed to the base particles (A1).

0.5 wt. part of colloidal silica (R-972, mfd. by Nihon Aerosil K.K.) was externally added to 100 wt. parts of the toner prepared above.

Separately, 100 wt. parts of 250–300 mesh ferrite particles were coated with 0.8 wt. part of a silicone resin thereby to prepare magnetic particles (carrier). Then, 10 wt. parts of the above toner were mixed with 100 wt. parts of the thus prepared magnetic particles thereby to prepare a developer.

The thus prepared developer wax charged into a developing device as shown in FIG. 5 and subjected to development in the same manner as in Example 2, whereby a clear yellow image with a high image density was obtained.

The thus developed image was then fixed by means of a fixing roller at a temperature of 180° C. at the surface thereof, whereby a fixed image with good fixability, and good anti-offset and anti-winding characteristics was obtained.

EXAMPLE 8

Modifier particles (B1) were prepared in the following manner.

| | |
|---|---|
| Styrene monomer | 90 wt. parts |
| Cyclized rubber | 10 wt. parts |
| Cr complex of di-tertiary-butyl-salicylic acid | 1 wt. part |
| C.I. Pigment Yellow 17 | 20 wt. parts |

The above ingredients were mixed at 70° C. for 5 min. To the resultant mixture, 3 wt. parts of 2,2'-azobis-(2,4-dimethylvaleronitrile) were added thereby to prepare a monomer composition.

The thus obtained monomer composition was charged in a 2 l-stainless steel vessel which already contained 12 wt. parts of amino-modified silica (obtained by treating 100 wt. parts of Aerosil #200 (mfd. by Nihon Aerosil K.K.) with 5 wt. parts of aminopropyltriethoxysilane), 600 wt. parts of distilled water and 30 wt. parts of 0.1N-hydrochloric acid, and the mixture was stirred at 60° C. for 60 minutes by means of a TK-homomixer (mfd. by Tokushu Kika Kogyo K.K.) rotating at 10,000 rpm for preliminary dispersion, to prepare a liquid dispersion. The dispersion was then subjected to granulation by means of a piston-type high pressure homogenizer (Model 15M-8TA, mfd. by Gaulin Corp.) at an ejection pressure of 400 kg/cm$^2$ for 5 min. The dispersion was then subjected to stirring by means of a paddle blade stirrer for 10 hours at 60° C. to complete the polymerization.

Thereafter, the dispersion was subjected to cooling, washing with an aqueous sodium hydroxide solution, dehydration and drying to obtain modifier particles (B1) having a volume-average particle size of 1.2 micron.

250 wt. parts of the thus prepared modifier particles (B1) and 1,000 wt. parts of the base particles (A1) prepared in Example 7 were treated in the same manner as in Example 7 thereby to obtain a toner.

According to an observation through an electron microscope, it was found that the modifier particles (B1) were fixed to the base particles (A1).

The thus prepared toner was subjected to image formation and fixation in the same manner as in Example 7, whereby good images were obtained. Further, the anti-offset and the anti-winding characteristics were also good.

EXAMPLE 9

| | |
|---|---|
| Styrene-butyl acrylate-divinylbenzene copolymer (weight ratio 80:20:1, weight-average molecular weight Mw: about 300,000) | 90 wt. parts |
| Cr complex of di-tertiary-butyl-salicylic acid | 2 wt. parts |

A mixture having the above prescription was melt-kneaded at 150° C. for about 30 min. by means of a roll mill. The obtained kneaded product was cooled and then pulverized by means of a pulverizer into particles having a volume-average particle size of about 10 microns. Fine powder was removed from the pulverized product by means of a zigzag classifier (mfd. by Alpine Co.) thereby to obtain base particles (A1) having a volume-average particle size of about 12 microns.

The thus prepared base particles (A1) was treated with the modifier particles (B1) prepared in Example 7 in the same manner as in Example 7 thereby to obtain a toner.

The thus prepared toner was subjected to image formation and fixation in the same manner as in Example 7, whereby good images were obtained. Further, the anti-offset and the anti-winding characteristics were also good similarly as in Example 7.

EXAMPLE 10

A toner was prepared in the same manner as in Example 1 except that carbon black was used as a colorant instead of C.I. Pigment Yellow 17 used in Example 7.

According to an observation through an electron microscope, it was found that the modifier particles were fixed to partial surfaces of the base particles.

The thus prepared toner was subjected to image formation and fixation in the same manner as in Example 7, whereby good images were obtained.

What is claimed is:

1. A process for producing a toner for developing electrostatic latent images comprising:

mixing resinous base particles (A) comprising at least a binder resin with modifier particles (B) comprising a colorant or a charge controller thereby to attach the modifier particles (B) to the surfaces of the base particles (A); and introducing the base particles (A) and the modifier particles (B) to a fixing means which has an impact zone having a minimum clearance of 0.5–5 mm between a rotating member and a fixed member or between at least two rotating members, and passing the particles through the impact zone at a temperature of 10°–100° C., thereby to fix the modifier particles (B) to the surfaces of the base particles (A) under the action of a mechanical impact force exerted in the impact zone.

2. A process according to claim 1, wherein the rotating member rotates to that the tip thereof forming the minimum clearance has a peripheral speed of 30–150 m/sec.

3. A process according to claim 2, wherein the rotating member rotates so that said tip has a peripheral speed of 30–130 m/sec.

4. A process according to claim 1, wherein the modifier particles (B) are fixed to the surfaces of the base particles (A) at a temperature of 20°–100° C.

5. A process according to claim 4, wherein the modifier particles (B) are fixed to the surfaces of the base particles (A) at a temperature of 20°–90° C.

6. A process according to claim 5, wherein the modifier particles (B) are fixed to the surfaces of the base particles (A) at a temperature of 30°–70° C.

7. A process according to claim 1, wherein the base particles (A) and the modifier particles (B) are introduced into the impact zone so that the total residence time therein is 0.2–12 sec.

8. A process according to claim 7, wherein the base particles (A) and the modifier particles (B) are recycled so that they pass through the impact zone plural times.

9. A process according to claim 1, wherein the base particles (A) have a volume-average particle size of 2–20 microns.

10. A process according to claim 1, wherein the modifier particles (B) have a volume-average particle size of 0.2 or less that of the base particles (A).

11. A process according to claim 1, wherein the modifier particles (B) are mixed with hydrophobic silica and then mixed with the base particles (A), and thereafter the modifier particles (B) are fixed to the surfaces of the base particles (A).

12. A process according to claim 1, wherein the base particles (A) are mixed with the modifier particles (B) at a temperature of 0°-50° C. for 1-60 min. by means of a mixer having a stirring vane, before fixing.

13. A process according to claim 1, wherein the base particles (A) comprise a binder resin having a softening point of 90°-150° C.

14. A process according to claim 13, wherein the base particles (A) comprise a binder resin of a crosslinked styrene-type copolymer.

15. A process according to claim 1, wherein the base particles (A) comprise a binder resin of a polyester resin.

16. A process according to claim 1, wherein the base particles (A) contain a colorant, and the modifier particles comprising a charge controller (B2) have a volume-average particle size which is 0.2 or less times that of the base particles (A) and have a triboelectric chargeability of 3 μc/g or above.

17. A process according to claim 16, wherein the modifier particles (B2) are fixed to the surfaces of the base particles (A) under the action of an impact force at a coverage of 0.1-50%.

18. A process according to claim 16, wherein the modifier particles (B2) comprise a charge controller as such.

19. A process according to claim 16, wherein the modifier particles (B2) comprise a charge controller and a resin.

20. A process according to claim 19, wherein the modifier particles (B2) comprise a resin having a glass transition temperature (Tg) of 50° C. or above.

21. A process according to claim 16, wherein the base particles (A) and the modifier particles (B2) are respectively prepared through suspension polymerization.

22. A process according to claim 21, wherein the base particles (A) comprise a binder resin of a crosslinked vinyl-type copolymer.

23. A process according to claim 1, wherein the modifier particles comprising a colorant (B1) have a volume-average particle size of 0.2 or less that of the base particles (A).

24. A process according to claim 23, wherein the base particles (A) do not contain the colorant which is used in the modifier particles (B1).

25. A process according to claim 24, wherein the base particles (A) are colorless particles containing substantially no colorant.

26. A process according to claim 23, wherein the modifier particles (B1) comprise the colorant as such.

27. A process according to claim 23, wherein the modifier particles (B1) comprise a resin and the colorant.

28. A process according to claim 27, wherein the modifier particles (B1) comprise a resin having a glass transition temperature (Tg) of 50° C. or above.

29. A process according to claim 23, wherein the base particles (A) and the modifier particles (B1) are respectively prepared through suspension polymerization.

30. A process according to claim 29, wherein the base particles (A) comprise a binder resin of a crosslinked vinyl-type copolymer.

31. A process according to claim 23, wherein the modifier particles (B1) are fixed to the surfaces of the base particles (A) under the action of a mechanical impact force at a coverage of 30-80%.

32. A process according to claim 16, wherein the modifier particles (B2) are fixed to the surfaces of the base particles (A) at a temperature of 20°-90° C.

33. A process according to claim 24, wherein the modifier particles (B1) are fixed to the surfaces of the base particles (A) at a temperature of 20°-90° C.

* * * * *

UNITED STATES PATENT AND TRADEMARK OFFICE

CERTIFICATE OF CORRECTION

PATENT NO. : 4,839,255

DATED : June 13, 1989

INVENTOR(S) : YOSHIHIKO HYOSU ET AL.

It is certified that error appears in the above-identified patent and that said Letters Patent is hereby corrected as shown below:

COLUMN 9

Formula I, "

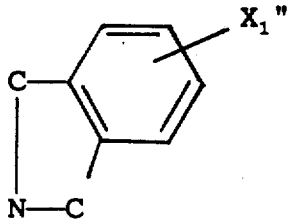

should read

--

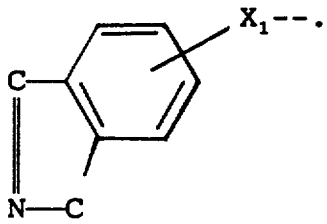

COLUMN 13

Line 14, "mode particle" or --mean particle--.
Line 23, "below-off" should read --blow-off--.
Line 31, "below-off method" should read --blow-off method--.

COLUMN 14

Line 34, "thereof" should be deleted.
Line 40, "methyl maleate," should read --, methyl maleate--.

UNITED STATES PATENT AND TRADEMARK OFFICE

CERTIFICATE OF CORRECTION

PATENT NO. : 4,839,255

DATED : June 13, 1989

INVENTOR(S) : YOSHIHIKO HYOSU ET AL.

It is certified that error appears in the above-identified patent and that said Letters Patent is hereby corrected as shown below:

COLUMN 16

Line 42, "octyl mechacrylate," should read --octyl methacrylate,--.

COLUMN 17

Line 28, "acrylic acid" should read --acrylic acid,--.
Line 66, "cyclic" should read --cyclized--.

COLUMN 18

Line 63, "aminoalkylmodified" should read --aminoalkyl-modified--.

COLUMN 21

Line 24, "a" (third occurrence) should be deleted.

COLUMN 22

Line 16, "(Henchel" should read --(Henschel--.
Line 17, "which is used" should be deleted.
Line 18, "in the pretreatment," should be deleted.
Line 22, "a locking device" should read --a locking device 8--.

COLUMN 23

Line 7, "preferably" should read --preferably be--.

UNITED STATES PATENT AND TRADEMARK OFFICE

CERTIFICATE OF CORRECTION

PATENT NO. : 4,839,255

DATED : June 13, 1989

INVENTOR(S) : YOSHIHIKO HYOSU ET AL.

It is certified that error appears in the above-identified patent and that said Letters Patent is hereby corrected as shown below:

COLUMN 26

Line 56, "a" (second occurrence) should be deleted.

COLUMN 35

Example 7, "Kagaky" should read --Kagaku--.

COLUMN 38

Line 36, "to that" should read --so--.
Line 63, "less that" should read --less times that--.

COLUMN 40

Line 6, "less that" should read --less times that--.

Signed and Sealed this

Fifth Day of February, 1991

*Attest:*

*Attesting Officer*

HARRY F. MANBECK, JR.

*Commissioner of Patents and Trademarks*